US007503393B2

(12) United States Patent
Shuster et al.

(10) Patent No.: US 7,503,393 B2
(45) Date of Patent: Mar. 17, 2009

(54) LUBRICATION SYSTEM FOR RADIALLY EXPANDING TUBULAR MEMBERS

(75) Inventors: Mark Shuster, Houston, TX (US); Kevin K. Waddell, Houston, TX (US); Larry Kendziora, Needville, TX (US); Scott Costa, Kingwood, TX (US)

(73) Assignee: Enventure Global Technology, Inc., Houston, TX (US)

( * ) Notice: Subject to any disclaimer, the term of this patent is extended or adjusted under 35 U.S.C. 154(b) by 523 days.

(21) Appl. No.: 10/543,364

(22) PCT Filed: Jan. 26, 2004

(86) PCT No.: PCT/US2004/002122

§ 371 (c)(1),
(2), (4) Date: Jul. 26, 2005

(87) PCT Pub. No.: WO2004/067961

PCT Pub. Date: Aug. 12, 2004

(65) Prior Publication Data

US 2006/0219414 A1 Oct. 5, 2006

Related U.S. Application Data

(60) Provisional application No. 60/442,938, filed on Jan. 27, 2003.

(51) Int. Cl.
*E21B 23/00* (2006.01)

(52) U.S. Cl. ..... 166/380; 166/207

(58) Field of Classification Search ..... 166/380, 166/384, 207

See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,225,005 | A | 5/1917 | Boyd et al. |
| 1,233,888 | A | 7/1917 | Leonard |

(Continued)

FOREIGN PATENT DOCUMENTS

| | | |
|---|---|---|
| AU | 767364 | 2/2004 |

(Continued)

OTHER PUBLICATIONS

Baker Hughes, "Expatch Expandable Cladding System," Oct. 2002.

(Continued)

*Primary Examiner*—William P Neuder
(74) *Attorney, Agent, or Firm*—Conley Rose, P.C.

(57) ABSTRACT

A lubrication system for lubricating an interface between one or more expansion surfaces of an expansion device and one or more interior surfaces of a tubular member during a radial expansion of the tubular member using the expansion device.

138 Claims, 20 Drawing Sheets

U.S. PATENT DOCUMENTS

| | | | |
|---|---|---|---|
| 1,358,818 | A | 11/1920 | Bering |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,739,932 | A | 12/1929 | Ventresca |
| 1,756,531 | A | 4/1930 | Aldeen et al. |
| 1,880,218 | A | 10/1932 | Simmons |
| 1,952,652 | A | 3/1934 | Brannon |
| 1,981,525 | A | 11/1934 | Price |
| 2,046,870 | A | 7/1936 | Clasen et al. |
| 2,087,185 | A | 7/1937 | Dillom |
| 2,110,913 | A | 3/1938 | Lowrey |
| 2,122,757 | A | 7/1938 | Scott |
| 2,134,311 | A | 10/1938 | Minor et al. |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,211,173 | A | 8/1940 | Shaffer |
| 2,214,226 | A | 9/1940 | English |
| 2,226,804 | A | 12/1940 | Carroll |
| 2,273,017 | A | 2/1942 | Boynton |
| 2,293,938 | A | 8/1942 | Dunn et al. |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,407,552 | A | 9/1946 | Hoesel |
| 2,447,629 | A | 8/1948 | Beissinger et al. |
| 2,481,637 | A | 9/1949 | Yancey |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,695,449 | A | 11/1954 | Chauvin |
| 2,723,721 | A | 11/1955 | Corsette |
| 2,734,580 | A | 2/1956 | Layne |
| 2,735,485 | A | 2/1956 | Metcalf, Jr. |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,331,439 | A | 7/1967 | Sanford |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,397,745 | A | 8/1968 | Owens et al. |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,463,228 | A | 8/1969 | Hearn |
| 3,477,506 | A | 11/1969 | Malone |
| 3,489,220 | A | 1/1970 | Kinley |
| 3,489,437 | A | 1/1970 | Duret |
| 3,498,376 | A | 3/1970 | Sizer et al. |
| 3,504,515 | A | 4/1970 | Reardon |
| 3,508,771 | A | 4/1970 | Duret |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,572,777 | A | 3/1971 | Blose et al. |
| 3,574,357 | A | 4/1971 | Alexandru et al. |
| 3,578,081 | A | 5/1971 | Bodine |
| 3,579,805 | A | 5/1971 | Kast |
| 3,581,817 | A | 6/1971 | Kammerer, Jr. |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,678,727 | A | 7/1972 | Jackson |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinely et al. |
| 3,789,648 | A | 2/1974 | Ames |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,826,124 | A | 7/1974 | Baksay |
| 3,830,294 | A | 8/1974 | Swanson |
| 3,830,295 | A | 8/1974 | Crowe |
| 3,834,742 | A | 9/1974 | McPhillips |
| 3,848,668 | A | 11/1974 | Sizer et al. |
| 3,866,954 | A | 2/1975 | Slator et al. |
| 3,874,446 | A | 4/1975 | Crowe |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |

3,915,763 A 10/1975 Jennings et al.
3,935,910 A 2/1976 Gaudy et al.
3,942,824 A 3/1976 Sable
3,945,444 A 3/1976 Knudson
3,948,321 A 4/1976 Owen et al.
3,963,076 A 6/1976 Winslow
3,970,336 A 7/1976 O'Sickey et al.
3,977,076 A 8/1976 Vieira et al.
3,977,473 A 8/1976 Page, Jr.
3,989,280 A 11/1976 Schwarz
3,997,193 A 12/1976 Tsuda et al.
3,999,605 A 12/1976 Braddick
4,003,433 A 1/1977 Goins
4,011,652 A 3/1977 Black
4,018,634 A 4/1977 Fenci
4,019,579 A 4/1977 Thuse
4,026,583 A 5/1977 Gottlieb
4,047,568 A 9/1977 Aulenbacher
4,053,247 A 10/1977 Marsh, Jr.
4,068,711 A 1/1978 Aulenbacher
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchison et al.
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,495,073 A 1/1985 Beimgraben
4,501,327 A 2/1985 Retz
4,505,017 A 3/1985 Schukei
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres et al.
4,595,063 A 6/1986 Jennings et al.
4,596,913 A 6/1986 Takechi
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,629,224 A 12/1986 Lanriault
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett et al.
4,682,797 A 7/1987 Hildner
4,685,191 A 8/1987 Mueller et al.
4,685,834 A 8/1987 Jordan
4,693,498 A 9/1987 Baugh et al.
4,703,802 A 11/1987 Bryan et al.
4,711,474 A 12/1987 Patrick
4,714,117 A 12/1987 Dech
4,730,851 A 3/1988 Watts
4,732,416 A 3/1988 Dearden et al.
4,735,444 A 4/1988 Skipper
4,739,654 A 4/1988 Pilkington et al.

4,739,916 A 4/1988 Ayres et al.
4,751,836 A 6/1988 Breese
4,754,781 A 7/1988 Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,799,544 A 1/1989 Curlett
4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Chang
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundel
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche P. et al.
5,242,017 A 9/1993 Hailey
5,249,628 A 10/1993 Surjaatmadja
5,253,713 A 10/1993 Gregg et al.
5,265,675 A 11/1993 Hearn et al.
RE34,467 E 12/1993 Reeves
5,275,242 A 1/1994 Payne
5,282,508 A 2/1994 Ellingsen et al.
5,282,652 A 2/1994 Werner
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,377,753 A 1/1995 Haberman et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,419,595 A 5/1995 Yamamoto et al.

5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,794,840 A 8/1998 Hohl et al.
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,887,476 A 3/1999 Damsohn et al.
5,895,079 A 4/1999 Carstensen et al.
5,899,268 A 5/1999 Lynde et al.
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
5,985,053 A 11/1999 Hara et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,013,724 A 1/2000 Mizutani et al.
6,015,012 A 1/2000 Reddick
6,017,168 A 1/2000 Fraser et al.
6,021,850 A 2/2000 Woo et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Shultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,148,915 A 11/2000 Mullen et al.
6,155,613 A 12/2000 Quadflieg et al.
6,158,785 A 12/2000 Beaulier et al.
6,158,963 A 12/2000 Hollis
6,167,970 B1 1/2001 Stout
6,182,775 B1 2/2001 Hipp
6,183,013 B1 2/2001 Mackenzie et al.
6,183,573 B1 2/2001 Fujiwara et al.
6,189,616 B1 2/2001 Gano et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.

6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,286,614 B1 9/2001 Gano et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,349,521 B1 2/2002 McKeon et al.
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,446,323 B1 9/2002 Metcalfe et al.
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta et al.
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup et al.
6,497,289 B1 12/2002 Cook et al.
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,575,250 B1 6/2003 Wijsman
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,609,735 B1 8/2003 DeLange et al.
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman et al.
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka et al.
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,826,937 B2 12/2004 Su
6,832,649 B2 12/2004 Bode et al.
6,834,725 B2 12/2004 Whanger et al.
6,843,319 B2 1/2005 Tran et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,902,652 B2 6/2005 Martin
6,923,261 B2 8/2005 Metcalfe et al.
6,935,429 B2 8/2005 Badrack
6,935,430 B2 8/2005 Harrall et al.

6,966,370 B2 11/2005 Cook et al.
6,968,618 B2 11/2005 Cook et al.
6,976,539 B2 12/2005 Metcalfe et al.
6,976,541 B2 12/2005 Brisco et al.
6,977,096 B2 12/2005 LeClaire
7,000,953 B2 2/2006 Berghaus
7,007,760 B2 3/2006 Lohbeck
7,011,161 B2 3/2006 Ring et al.
7,021,390 B2 4/2006 Cook et al.
7,036,582 B2 5/2006 Cook et al.
7,040,396 B2 5/2006 Cook et al.
7,044,218 B2 5/2006 Cook et al.
7,044,221 B2 5/2006 Cook et al.
7,048,062 B2 5/2006 Ring et al.
7,048,067 B1 5/2006 Cook et al.
7,055,608 B2 6/2006 Cook et al.
7,063,142 B2 6/2006 Cook et al.
7,063,149 B2 6/2006 Simpson et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,685 B2 9/2006 Cook et al.
7,108,072 B2 * 9/2006 Cook et al. ..... 166/380
7,114,559 B2 10/2006 Sonnier et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,164,964 B2 1/2007 Stacklies
7,185,710 B2 3/2007 Cook et al.
7,191,841 B2 3/2007 Sivley, IV
7,225,879 B2 6/2007 Wylie et al.
7,231,985 B2 6/2007 Cook et al.
7,234,531 B2 6/2007 Kendziora et al.
7,234,968 B2 6/2007 Lottmann et al.
7,240,728 B2 7/2007 Cook et al.
7,240,729 B2 7/2007 Cook et al.
2001/0002626 A1 6/2001 Frank et al.
2001/0018354 A1 8/2001 Pigni
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Sivley, IV
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045646 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0112610 A1 6/2004 Tran et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0194966 A1 10/2004 Zimmerman
2004/0195826 A1 10/2004 Goto
2004/0216506 A1 11/2004 Simpson et al.
2004/0216873 A1 11/2004 Frost, Jr. et al.
2004/0221996 A1 11/2004 Burge
2004/0231839 A1 11/2004 Ellington et al.
2004/0231843 A1 11/2004 Simpson et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.

| | | | | |
|---|---|---|---|---|
| 2005/0144772 | A1 | 7/2005 | Cook et al. | |
| 2005/0144777 | A1 | 7/2005 | Cook et al. | |
| 2005/0150098 | A1 | 7/2005 | Cook et al. | |
| 2005/0150660 | A1 | 7/2005 | Cook et al. | |
| 2005/0161228 | A1 | 7/2005 | Cook et al. | |
| 2005/0166387 | A1 | 8/2005 | Cook et al. | |
| 2005/0166388 | A1 | 8/2005 | Cook et al. | |
| 2005/0173108 | A1 | 8/2005 | Cook et al. | |
| 2005/0175473 | A1 | 8/2005 | Cook et al. | |
| 2005/0183863 | A1 | 8/2005 | Cook et al. | |
| 2005/0205253 | A1 | 9/2005 | Cook et al. | |
| 2005/0217768 | A1 | 10/2005 | Asahi et al. | |
| 2005/0217865 | A1 | 10/2005 | Ring et al. | |
| 2005/0217866 | A1 | 10/2005 | Watson et al. | |
| 2005/0223535 | A1 | 10/2005 | Cook et al. | |
| 2005/0224225 | A1 | 10/2005 | Cook et al. | |
| 2005/0230102 | A1 | 10/2005 | Cook et al. | |
| 2005/0230103 | A1 | 10/2005 | Cook et al. | |
| 2005/0230104 | A1 | 10/2005 | Cook et al. | |
| 2005/0230123 | A1 | 10/2005 | Cook et al. | |
| 2005/0236159 | A1 | 10/2005 | Cook et al. | |
| 2005/0236163 | A1 | 10/2005 | Cook et al. | |
| 2005/0244578 | A1 | 11/2005 | Van Egmond et al. | |
| 2005/0246883 | A1 | 11/2005 | Alliot et al. | |
| 2005/0247453 | A1 | 11/2005 | Shuster et al. | |
| 2005/0265788 | A1 | 12/2005 | Renkema | |
| 2005/0269107 | A1 | 12/2005 | Cook et al. | |
| 2006/0027371 | A1 | 2/2006 | Gorrara | |
| 2006/0032640 | A1 | 2/2006 | Costa et al. | |
| 2006/0048948 | A1 | 3/2006 | Noel | |
| 2006/0054330 | A1 | 3/2006 | Metcalfe et al. | |
| 2006/0065403 | A1 | 3/2006 | Watson et al. | |
| 2006/0065406 | A1 | 3/2006 | Shuster et al. | |
| 2006/0096762 | A1 | 5/2006 | Brisco | |
| 2006/0102360 | A1 | 5/2006 | Brisco et al. | |
| 2006/0112768 | A1 | 6/2006 | Shuster et al. | |
| 2006/0113086 | A1 | 6/2006 | Costa et al. | |
| 2006/0266527 | A1 | 11/2006 | Brisco et al. | |
| 2006/0272826 | A1 | 12/2006 | Shuster et al. | |
| 2007/0131431 | A1* | 6/2007 | Shuster et al. ..... | 166/380 |
| 2007/0154270 | A1 | 7/2007 | Waddell et al. | |

FOREIGN PATENT DOCUMENTS

| | | | |
|---|---|---|---|
| AU | 773168 | | 5/2004 |
| AU | 770008 | | 7/2004 |
| AU | 770359 | | 7/2004 |
| AU | 771884 | | 8/2004 |
| AU | 776580 | | 1/2005 |
| AU | 2001294802 | | 10/2005 |
| AU | 2001283026 | | 7/2006 |
| AU | 2002239857 | | 8/2006 |
| AU | 2001292695 | | 10/2006 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2419806 | | 4/2002 |
| CA | 2453034 | | 1/2003 |
| CA | 2234386 | | 3/2003 |
| CA | 2466685 | | 3/2004 |
| CA | 2414449 | | 9/2006 |
| CA | 2249139 | | 1/2007 |
| CA | 2289811 | | 1/2007 |
| DE | 174521 | | 4/1953 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 620289 | A1 | 10/1994 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1106778 | A1 | 6/2001 |
| EP | 1152119 | A2 | 11/2001 |
| EP | 1152120 | A2 | 11/2001 |
| EP | 1152120 | A3 | 11/2001 |
| EP | 1306519 | A2 | 5/2003 |
| EP | 1505251 | A2 | 2/2005 |
| EP | 1505251 | A3 | 2/2007 |
| FR | 1325596 | | 6/1962 |
| FR | 1325596 | | 3/1963 |
| FR | 2717855 | A1 | 9/1995 |
| FR | 2741907 | A1 | 6/1997 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 1008383 | | 7/1962 |
| GB | 961750 | | 6/1964 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2124275 | A | 2/1984 |
| GB | 2125876 | A | 3/1984 |
| GB | 2194978 | A | 3/1988 |
| GB | 2211446 | A | 7/1989 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2275705 | A | 9/1994 |
| GB | 2279383 | | 1/1995 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2331103 | A | 5/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2345308 | A | 7/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2348661 | A | 10/2000 |
| GB | 2357099 | A | 12/2000 |
| GB | 2356651 | A | 5/2001 |
| GB | 2350137 | B | 8/2001 |

| | | | |
|---|---|---|---|
| GB | 2361724 | | 10/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382607 | A | 6/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396634 | A | 6/2004 |
| GB | 2396635 | A | 6/2004 |
| GB | 2396639 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |

| | | | |
|---|---|---|---|
| GB | 2403971 | A | 1/2005 |
| GB | 2403972 | A | 1/2005 |
| GB | 2400624 | B | 2/2005 |
| GB | 2404402 | A | 2/2005 |
| GB | 2404676 | A | 2/2005 |
| GB | 2404677 | A | 2/2005 |
| GB | 2404680 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2408278 | B | 2/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2418690 | B | 8/2006 |
| GB | 2421257 | B | 8/2006 |
| GB | 2421258 | B | 8/2006 |
| GB | 2422859 | A | 8/2006 |
| GB | 2422860 | A | 8/2006 |
| GB | 2423317 | | 8/2006 |
| GB | 2404676 | B | 9/2006 |
| GB | 2414493 | B | 9/2006 |
| GB | 2424077 | A | 9/2006 |
| GB | 2429482 | A | 2/2007 |
| GB | 2410280 | B | 4/2007 |
| GB | 2412178 | B | 5/2007 |
| GB | 2415215 | B | 5/2007 |
| GB | 2408277 | A | 5/2008 |
| ID | 02.P01.012.197 | | 1/2005 |
| ID | 02.03.09.044.392 | | 9/2005 |
| ID | 02.03.09.046.2804 | | 8/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1785241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 1295799 | A1 | 2/1995 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |

| | | | |
|---|---|---|---|
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO 93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO 96/10710 | | 11/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO 98/22690 | | 5/1998 |
| WO | WO98/26152 | | 6/1998 |
| WO | WO98/42947 | | 10/1998 |
| WO | WO 98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO 00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO 00/37771 | A1 | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO 01/18354 | A1 | 3/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |
| WO | WO 02/38343 | A2 | 5/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |

| | | | |
|---|---|---|---|
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO 03/093624 | | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO 2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO 2004/027201 | A2 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092526 | A2 | 10/2004 |
| WO | WO2004/092527 | A2 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020810 | A3 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020913 | A3 | 2/2006 |
| WO | WO2006/020960 | A2 | 2/2006 |
| WO | WO2006/033720 | A2 | 3/2006 |
| WO | WO2004/089608 | A3 | 7/2006 |
| WO | WO2006/079072 | A2 | 7/2006 |
| WO | WO2006/088743 | A2 | 8/2006 |
| WO | WO 2006/096762 | A1 | 9/2006 |
| WO | WO2006/102171 | A2 | 9/2006 |
| WO | WO2006/102556 | A2 | 9/2006 |

OTHER PUBLICATIONS

Baker Hughes, "Express Expandable Screen System."

Baker Hughes, "Formlock Expandable Liner Hangers."

Banabic, "Research Projects," Jan. 30, 1999.

Cales et al., "Subsidence Remediation—Extending Well Life Through the Use of Solid Expandable Casing Systems," *AADE Houston Chapter*, Mar. 27, 2001.

Case History, "Eemskanaal—2 Groningen," Enventure Global Technology, Feb. 2002.

Case History, "Graham Ranch No. 1 Newark East Barnett Field" Enventure Global Technology, Feb. 2002.

Case History, "K.K. Camel No. 1 Ridge Field Lafayette Parish, Louisiana," Enventure Global Technology, Feb. 2002.

Case History, "Mississippi Canyon 809 URSA TLP, OSC-G 5868, No. A-12," Enventure Global Technology, Mar. 2004.

Case History, "Yibal 381 Oman," Enventure Global Technology, Feb. 2002.

Data Sheet, "Enventure Openhole Liner (OHL) System" Enventure Global Technology, Dec. 2002.

Duphorne, "Letter Re: Enventure Claims of Baker Infringement of Enventure's Expandable Patents," Apr. 1, 2005.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
"Expandable Casing Accesses Remote Reservoirs," *Petroleum Engineer International*, Apr. 1999.
Fraunhofer Iwu, "Research Area: Sheet Metal Forming—Superposition of Vibrations," 2001.
"Innovators Chart the Course."
Linzell, "Trib-Gel A Chemical Cold Welding Agent," 1999.
Mohawk Energy, :Minimizing Drilling Ecoprints Houston, Dec. 16, 2005.
News Release, "Shell and Halliburton Agree to Form Company to Develop and Market Expandable Casing Technology," Jun. 3, 1998.
Sanders et al., Practices for Providing Zonal Isolation in Conjunction with Expandable Casing Jobs—Case Histories, 2003.
"Set Technology: The Facts" 2004.
"Slim Well:Stepping Stone to MonoDiameter," *Hart's E&P*, Jun. 2003.
www.MITCHMET.com, "3d Surface Texture Parameters," 2004.
www.SPURIND.com, "Glavanic Protection, Metallurgical Bonds, Custom Fabrications—Spur Industries," 2000.
"Expand Your Opportunities." *Enventure*. CD-ROM. Jun. 1999.
"Expand Your Opportunities." *Enventure*. CD-ROM. May 2001.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US02/39425, Nov. 16, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005 (Corrected).
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/15020 (corrected), Nov. 14, 2004.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/28438, Sep. 20, 2005.
Written Opinion to Application No. PCT/US03/25675, May 9, 2005.
Combined Search Report and Written Opinion to Application No. PCT/US04/10762, Sep. 1, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28831, Dec. 19, 2005.
Combined Search Report and Written Opinion to Application No. PCT/US04/28889, Nov. 14, 2005.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0400018.8, May 17, 2005.
Examination Report to Application No. GB 0400019.6, Sep. 2, 2005.
Examination Report to Application No. GB 0400019.6, Nov. 4, 2005.
Examination Report to Application No. GB 0404833.6, Aug. 19, 2004.
Examination Report to Application No. GB 0406257.6, Sep. 2, 2005.
Examination Report to Application No. GB 0406257.6, Nov. 9, 2005.
Examination Report to Application No. GB 0406258.4, Jul. 27, 2005.
Examination Report to Application No. GB 0416834.0, Nov. 16, 2004.
Examination Report to Application No. GB 0422419.2, Dec. 8, 2004.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 9, 2005.
Examination Report to Application No. GB 0428141.6, Sep. 15, 2005.
Examination Report to Application No. GB 0500184.7, Sep. 12, 2005.
Examination Report to Application No. GB 0500600.2, Sep. 6, 2005.
Examination Report to Application No. GB 0503250.3, Nov. 15, 2005.
Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Examination Report to Application No. GB 0507980.1, Sep. 29, 2005.
Examination Report to Application No. GB 0517448.7, Nov. 9, 2005.

Examination Report to Application No. GB 0518025.2, Oct. 27, 2005.
Examination Report to Application No. GB 0518039.3, Nov. 29, 2005.
Examination Report to Application No. GB 0518252.2, Oct. 28, 2005.
Examination Report to Application No. GB 0518799.2, Nov. 9, 2005.
Examination Report to Application No. GB 0518893.3, Dec. 16, 2005.
Examination Report to Application No. GB 0521024.0, Dec. 22, 2005.
Examination Report to Application No. GB 0522050.4, Dec. 13, 2005.
Search and Examination Report to Application No. GB 0412876.5, Sep. 27, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Examination Report to Application No. AU 2003257878, Jan. 19, 2006.
Examination Report to Application No. AU 2003257881, Jan. 19, 2006.
Search Report to Application No. EP 02806451.7; Feb. 9, 2005.
Search Report to Application No. EP 03071281.2; Nov. 14, 2005.
Search Report to Application No. EP 03723674.2; Nov. 22, 2005.
Search Report to Application No. Norway 1999 5593, Aug. 20, 2002.
Halliburton Energy Services, "Halliburton Completion Products" 1996, Page Packers 5-37, United States of America.
Baker Hughes Incorporated, "EXPatch Expandable Cladding System" (2002).
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low-Temperature Bonding of Dissimilar and Hard-to-Bond Materials and Metal-Including . . . " (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Tribology Transactions "Experimental Investigation of Laser Texturing for Reciprocating Automotive Components" G Ryk, Y Klingermand and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Letter From Baker Oil Tools to William Norvell in Regards to Enventure's Claims of Baker Infringement Of Enventure's Expandable Patents Apr. 1, 2005.
Offshore, "Agbada Well Solid Tubulars Expanded Bottom Up, Screens Expanded Top Down" William Furlow, Jan. 2002.
Drilling Contractor, "Solid Expandable Tubulars are Enabling Technology" Mar./Apr. 2001.
Hart's E & P, "SET Technology: Setting the Standard" Mar. 2002.
Hart's E & P, "An Expanded Horizon" Jim Brock, Lev Ring, Scott Costa, Andrei Filippov. Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
"Case Study: Value in Drilling Derived From Application-Specific Technology" Langley, Diane., Oct. 2004.
L'Usine Nouvelle, "Les Tubes Expansibles Changent La Face Du Forage Petroller" Demoulin, Laurence, No. 2878 . pp. 50-52, Jul. 3, 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Enable Multilaterals Without Compromise on Hole Size," DeMong, Karl, et al., Jun. 2003.
Offshore Engineer, "From Exotic to Routine—the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultradeepwater Well," Furlow, William, Dec. 2000.

Offshore Engineer, "Oilfield Service Trio Target Jules Verne Territory," Von Flater, Rick., Aug. 2001.
Offshore, "Expandable Casing Program Helps Operator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Foniova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills World's First Monodiameter Well in South Texas" Sumrow, Mike., Oct. 21, 2002.
World Oil, "Expandables and the Dream of the Monodiameter Well: A Status Report", Fischer, Perry, Jul. 2004.
World Oil, "Well Remediation Using Expandable Cased-Hole Liners", Merritt, Randy et al., Jul. 2002.
World Oil, "How in Situ Expansion Affects Casing and Tubing Properties", Mack, R.D., et al., Jul. 1999. pp. 69-71.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technology" Patin, Michael, et al., 2003.
Offshore Technology Conference, "Expandable Cased-hole Liner Remediates Prolific Gas Well and Minimizes Loss of Production" Buckler Bill, et al., 2002.
Offshore Technology Conference, "Development and Field Testing of Solid Expandable Corrosion Resistant Cased-hole Liners to Boost Gas Production in Corrosive Environments" Siemers Gertjan, et al., 2003.
"Practices for Providing Zonal Isolation in Conjunction with Expandable Casing Jobs—Case Histories" Sanders, T, et al. 2003.
Society of Petroleum Engineers, "Increasing Solid Expandable Tubular Technology Reliability in a Myriad of Downhole Environments", Escobar, C. et al., 2003.
Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Environment" Dupal, Kenneth, et al., 2001.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the Use of Solid Expandable Casing Systems" Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories—Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthrough Using Solid Expandable Tubulars to Construct Extended Reach Wells" Demong, Karl, et al., 2004.
Deep Offshore Technology Conference "Meeting Economic Challenges of Deepwater Drilling with Expandable-Tubular Technology" Haut, Richard, et al., 1999.
Offshore Technology Conference, "Field Trial Proves Upgrades to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.
Society of Petroleum Engineers, "Changing Safety Paradigms in the Oil and Gas Industry" Ratilff, Matt, et al., 2004.
Society of Petroleum Engineers, "Window Exit Sidetrack Enhancements Through the Use of Solid Expandable Casing", Rivenbark, Mark, et al., 2004.
Data Sheet, "Enventure Cased-Hole Liner (CHL) System" *Enventure Global Technology*, Dec. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.
Case History, "Eemskanaal—2 Groningen" Enventure Global Technology, Feb. 2002.
Case History, "Ylbal 381 Oman" Enventure Global Technology, Feb. 2002.
Case History, "Mississippi Canyon 809 URSA TLP, OSC-G 5868, No. A-12" Enventure Global Technology, Mar. 2004.

Case History, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608 Sep. 13, 2004.
Written Opinion to Application No. PCT/US02/25608 Feb. 2, 2005.
Written Opinion to Application No. PCT/US03/25675 Nov. 24, 2004.
Written Opinion to Application No. PCT/US02/25727; May 17, 2004.
Written Opinion to Application No. PCT/US02/39418; Jun. 9, 2004.
Written Opinion to Application No. PCT/US02/39425; Nov. 22, 2004.
Written Opinion to Application No. PCT/US02/39425; Apr. 11, 2005.
Written Opinion to Application No. PCT/US03/06544; Feb. 18, 2005.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/25675 May 9, 2005.
Written Opinion to Application No. PCT/US03/29858 Jan. 21, 2004.
Written Opinion to Application No. PCT/US03/38550 Dec. 10, 2004.
Written Opinion to Application No. PCT/US04/08171 May 5, 2005.
Adams, "Drilling Engineering: A Complete Well Planning Approach," 1985.
Dupal et al., "Well Design with Expandable Tubulars Reduces Cost and Increases Success in Deepwater Applications," *Deep Offshore Technology*, 2000.
"Pipeline Rehabilitation by Sliplining with Polyethylene Pipe" 2006.
www.RIGZONE.com/news/article.asp?a_id=1755, "Tesco Provides Casing Drilling Operations Update," 2001.
www.RIGZONE.com/news/article.asp?a_id=2603, Conoco and Tesco Unveil Revolutionary Drilling Rig 2002.
International Search Report, Application PCT/US03/15020, Nov. 14, 2005.
International Preliminary Examination Report, Application PCT/US01/28690, Sep. 4, 2003.
International Preliminary Report on Patentability, Application PCT/US04/00631, Mar. 2, 2006.
International Preliminary Report on Patentability, Application PCT/US04/04740, Jun. 27, 2006.
International Preliminary Report on Patentability, Application PCT/US04/10317, Jun. 23, 2006.
International Preliminary Report on Patentability, Application PCT/US04/028423, Mar. 9, 2006.
International Preliminary Report on Patentability, Application PCT/US04/028423, Jun. 19, 2006.
International Preliminary Report on Patentability, Application PCT/US04/28889, Aug. 1, 2006.
Combined Search Report and Written Opinion to Application No. PCT/US04/07711, Nov. 28, 2006.
Combined Search Report and Written Opinion to Application No. PCT/US04/10317, May 25, 2006.
Combined Search Report and Written Opinion to Application No. PCT/US05/28473, Sep. 1, 2006.
Combined Search Report and Written Opinion to Application No. PCT/US05/28642, Jul. 14, 2006.
Combined Search Report and Written Opinion to Application No. PCT/US05/28819, Aug. 3, 2006.
Combined Search Report and Written Opinion to Application No. PCT/US05/28869, Apr. 17, 2006.
Combined Search Report and Written Opinion to Application No. PCT/US06/04809, Aug. 29, 2006
Combined Search Report and Written Opinion to Application No. PCT/US06/09886, Dec. 4, 2006.
Search Report to Application No. GB 0507980.1, Apr. 24, 2006.
Examination Report to Application No. GB 0219757.2, Oct. 31, 2004.
Examination Report to Application No. GB 03701281.2, Jan. 31, 2006.
Examination Report to Application No. GB 03723674.2, Feb. 6, 2006.
Examination Report to Application No. GB 0406257.6, Apr. 28, 2006.
Examination Report to Application No. GB 0408672.4, Jul. 12, 2004.
Examination Report to Application No. GB 0412876.5, Feb. 13, 2006.
Examination Report to Application No. GB 0428141.6, Feb. 21, 2006.
Examination Report to Application No. GB 0428141.6, Jul. 18, 2006.
Examination Report to Application No. GB 0500275.3, Apr. 5, 2006.
Examination Report to Application No. GB 0501667.0, Jan. 27, 2006.
Examination Report to Application No. GB 0503250.3, Mar. 2, 2006.
Examination Report to Application No. GB 0503250.3, Aug. 11, 2006.
Examination Report to Application No. GB 0506699.8, May 11, 2006.
Examination Report to Application No. GB 0506700.4, May 16, 2006.
Examination Report to Application No. GB 0506702.0, May 11, 2006.
Examination Report to Application No. GB 0506702.0, Jul. 24, 2006.
Examination Report to Application No. GB 0507979.3, Jan. 17, 2006.
Examination Report to Application No. GB 0507979.3, Jun. 6, 2006.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509630.0, May 11, 2006.

Examination Report to Application No. GB 0509630.0, Jun. 6, 2006.
Examination Report to Application No. GB 0509631.8, Feb. 14, 2006.
Examination Report to Application No. GB 0517448.7, Jul. 19, 2006.
Examination Report to Application No. GB 0518025.2, May 25, 2006.
Examination Report to Application No. GB 0518039.3, Aug. 2, 2006.
Examination Report to Application No. GB 0518252.2, May 25, 2006.
Examination Report to Application No. GB 0518799.2, Jun. 14, 2006.
Examination Report to Application No. GB 0518893.3, Jul. 28, 2006.
Examination Report to Application No. GB 0519989.8, Mar. 8, 2006.
Examination Report to Application No. GB 0521931.6, Nov. 8, 2006.
Examination Report to Application No. GB 0522892.9, Aug. 14, 2006.
Examination Report to Application No. GB 0602877.3, Mar. 20, 2006.
Examination Report to Application No. GB 0603576.0, Apr. 5, 2006.
Examination Report to Application No. GB 0603576.0, Nov. 9, 2006.
Examination Report to Application No. GB 0603656.0, May 3, 2006.
Examination Report to Application No. GB 0603656.0, Nov. 10, 2006.
Examination Report to Application No. GB 0603995.2, Apr. 25, 2006.
Examination Report to Application No. GB 0603996.0, Apr. 27, 2006.
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.
Search and Examination Report to Application No. GB 0507980.1, Jun. 20, 2006.
Search and Examination Report to Application No. GB 0522155.1, Mar. 7, 2006.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Search and Examination Report to Application No. GB 0602877.3, Sep. 25, 2006.
Search and Examination Report to Application No. GB 0609173.0, Jul. 19, 2006.
Search and Examination Report to Application No. GB 0613405.0, Nov. 2, 2006.
Search and Examination Report to Application No. GB 0613406.8, Nov. 2, 2006.
Examination Report to Application No. AU 2003257878, Jan. 30, 2006.
Examination Report to Application No. AU 2003257881, Jan. 30, 2006.
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examination Report to Application No. AU 2004202813, Jun. 14, 2006.
Examination Report to Application No. AU 2004202815, Jun. 14, 2006.
Search Report to Application No. EP 03723674.2; May 2, 2006.
Search Report to Application No. EP 03728326.4; Mar. 13, 2006.
Search Report to Application No. EP 03728326.4; Apr. 24, 2006.
Search Report to Application No. EP 03752486.5; Feb. 8, 2006.
Examination Report to Application No. EP 03752486.5; Jun. 28, 2006.
Search Report to Application No. EP 03759400.9; Mar. 3, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006.
Examination Report to Application No. Norway 2002 1613, May 13, 2006.
Examination Report to Application No. Norway 20023885, May 29, 2006.
Examination Report To Application No. Canada 2298139, Nov. 15, 2006.
Examination Report dated Oct. 13, 2006 on Australian Patent Application No. 200400246.
Examination Report dated Sep. 22, 2006 on Australian Patent Application No. 2004200248.
Examination Report dated Mar. 7, 2007 on Australian Patent Application No. 2002367017.
Examination Report dated Jun. 5, 2007 on Brazilian patent application No. PI 9906143-0.
Examination Report dated Oct. 16, 2007 on Brazilian patent application No. PI 0003319-7.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.
Examination Report dated Feb. 26, 2007 on Canadian Patent Application No. 2389094.
Examination Report dated Oct. 11, 2007 on European Patent Application No. 2806451.7.
Examination Report dated Jul. 4, 2007 on European Patent Application No. 3728326.4.
Examination Report dated Apr. 2, 2007 on European Patent Application No. 3701281.2.
Examination Report dated Jan. 10, 2007 on European Patent Application No. 3723674.2.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.0.
Examination Report dated Sep. 13, 2007 on British Patent application No. 604360.8.
Examination Report dated Aug. 7, 2007 on British Patent application No. 613924.0.
Examination Report dated May 23, 2007 on British patent application No. 621060.3.
Examination Report dated Jul. 23, 2007 on British patent application No. 621060.3.
Examination Report dated Jun. 21, 2007 on British patent application No. 621059.5.
Examination Report dated Aug. 8, 2007 on British patent application No. 621059.5.
Examination Report dated Jun. 21, 2007 on British patent application No. 621053.8.
Examination Report dated Aug. 13, 2007 on British patent application No. 621053.8.
Examination Report dated Aug. 17, 2007 on British patent application No. 603576.
Examination Report dated Aug. 7, 2007 on British patent application No. 613924.
Examination Report dated May 23, 2007 on British patent application No. 621062.9.
Examination Report dated Jul. 23, 2007 on British patent application No. 621062.9.
Examination Report dated Apr. 5, 2007 on British patent application No. 613406.8.
Examination Report dated Jun. 22, 2007 on British patent application No. 609173.
Examination Report dated Sep. 14, 2007 on British patent application No. 623634.3.

Examination Report dated Jul. 5, 2007 on British patent application No. 624328.1.
Examination Report dated Sep. 4, 2007 on British patent application No. 624328.1.
Examination Report dated Oct. 26, 2007 on British patent application No. 624328.1.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5
Examination Report dated Aug. 15, 2007 on British patent application No. 625615.
Examination Report dated Jul. 26, 2007 on British patent application No. 522049.6.
Examination Report dated Mar. 5, 2007 on British patent application No. 522049.6.
Examination Report dated Sep. 7, 2007 on British patent application No. 522049.6.
Examination Report dated Aug. 16, 2007 on British patent application No. 625636.6.
Examination Report dated Jul. 16, 2007 on British patent application No. 522155.1.
Examination Report dated Sep. 26, 2007 on British patent application No. 624781.1.
Search and Examination Report dated Aug. 16, 2007 on British patent application No. 621054.6.
Search and Examination Report dated Oct. 5, 2007 on British patent application No. 623631.9.
Search and Examination Report dated Mar. 30, 2007 on British patent application No. 702797.2.
Search and Examination Report dated Aug. 2, 2007 on British patent application No. 702797.2.
Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.
Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Oct. 10, 2007 on British patent application No. 603995.2.
Search and Examination Report dated Mar. 15, 2007 on British patent application No. 6043593.
Search and Examination Report dated Mar. 15, 2007 on British patent application No. 604360.8.
Search Report dated Jun. 6, 2007 on British patent application No. 613406.8.
Substantive Examination dated Jul. 25, 2007 on Mexican patent application No. PA/A/2004/006681.
Examination Report dated Oct. 5, 2007 on Mexican patent application No. PA/A/2005/003117.
Examination Report dated Oct. 16, 2007 on Mexican patent application No. PA/A/2005/003116.
Examination Report dated Oct. 5, 2007 on Mexican patent application No. PA/A/2004/007922.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent application No. 20000924.
International Preliminary Exam Report dated May 23, 2007 on International patent application No. PCT/US06/009886.
Written Opinion of ISA dated Aug. 2, 2007 on International patent application No. PCT/US05/028451.
Search Report of ISA dated Aug. 2, 2007 on International patent application No. PCT/US05/028451.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Feb. 24, 2004.
International Search Report, Application PCT/US02/00677, Jul. 17, 2002.
International Search Report, Application PCT/US02/04353, Jun. 24, 2002.
International Search Report, Application PCT/US02/20256, Jan. 3, 2003.
International Search Report, Application PCT/US02/20477; Apr. 6, 2004.
International Search Report, Application PCT/US02/20477; Oct. 31, 2003.
International Search Report, Application PCT/US02/24399; Feb. 27, 2004.
International Examination Report, Application PCT/US02/24399, Aug. 6, 2004.

International Examination Report, Application PCT/US02/25608; Jun. 1, 2005.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/29856, Dec. 16, 2002.
International Search Report, Application PCT/US02/36157; Apr. 14, 2004.
International Search Report, Application PCT/US02/36157; Sep. 29, 2003.
International Examination Report, Application PCT/US02/36267, Jan. 4, 2004.
International Search Report, Application PCT/US02/36267; May 21, 2004.
International Examination Report, Application PCT/US02/39418, Feb. 18, 2005.
International Search Report, Application PCT/US02/39418, Mar. 24, 2003.
International Search Report, Application PCT/US02/39425, May 28, 2004.
International Search Report, Application PCT/US03/00609, May 20, 2004.
International Examination Report, Application PCT/US03/04837, Dec. 9, 2004.
International Search Report, Application PCT/US03/04837, May 28, 2004.
International Examination Report, Application PCT/US03/06544, May 10, 2005.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Examination Report, Application PCT/US03/11765; Dec. 10, 2004.
International Search Report, Application PCT/US03/11765; Nov. 13, 2003.
International Examination Report, Application PCT/US03/11765;; Jan. 25, 2005.
International Examination Report, Application PCT/US03/11765; Jul. 18, 2005.
International Search Report, Application PCT/US03/13787; May 28, 2004.
International Examination Report, Application PCT/US03/13787; Apr. 7, 2005.
International Examination Report, Application PCT/US03/13787; Mar. 2, 2005.
International Search Report, Application PCT/US03/14153; May 28, 2004.
International Examination Report, Application PCT/US03/14153; May 12, 2005.
International Search Report, Application PCT/US03/15020; Jul. 30, 2003.
International Examination Report, Application PCT/US03/15020, May 9, 2005.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/20870; Sep. 30, 2004.
International Search Report, Application PCT/US03/24779; Mar. 3, 2004.
International Examination Report, Application PCT/US03/25667, May 25, 2005.
International Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.
International Examination Report, Application PCT/US03/25677, Aug. 17, 2004.
International Search Report, Application PCT/US03/25707; Jun. 23, 2004.
International Search Report, Application PCT/US03/25715; Apr. 9, 2004.
International Search Report, Application PCT/US03/25716; Jan. 13, 2005.
International Search Report, Application PCT/US03/25742; Dec. 20, 2004.
International Search Report, Application PCT/US03/25742; May 27, 2004.
International Search Report, Application PCT/US03/29460; May 25, 2004.
International Examinaton Report, Application PCT/US03/29460; Dec. 8, 2004.
International Search Report, Application PCT/US03/25667; Feb. 26, 2004.
International Search Report, Application PCT/US03/29858; Jun. 30, 2003.
International Examination Report, Application PCT/US03/29858; May 23, 2005.
International Search Report, Application PCT/US03/29859; May 21, 2004.
International Examinatoin Report, Application PCT/US03/29859, Aug. 16, 2004.
International Search Report, Application PCT/US03/38550; Jun. 15, 2004.
International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB 0004285.3, Jan. 17, 2001.
Search Report to Application No. GB 0004285.3, Jan. 19, 2001.
Examination Report to Application No. 0004285.3, Mar. 28, 2003.
Search Report to Application No. GB 0004285.3, Aug. 28, 2002.
Examination Report to Application No. GB 0005399.1; Jul. 24, 2000.
Search Report to Application No. GB 0005399.1, Feb. 15, 2001.
Examination Report to Application No. GB 0005399.1; Oct. 14, 2002.
Search Report to Application No. GB 0013661.4, Oct. 20, 2000.
Search Report to Application No. GB 0013661.4, Feb. 19, 2003.
Search Report to Application No. GB 0013661.4, Apr. 17, 2001.
Examination Report to Application No. GB 0013661.4, Nov. 25, 2003.
Search Report to Application No. GB 0013661.4, Oct. 20, 2003.
Examination Report to Application No. GB 0208367.3, Apr. 4, 2003.

Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Examination Report to Application No. GB 0219757.2, May 10, 2004.
Search Report to Application No. GB 0220872.6, Dec. 5, 2002.
Search Report to Application GB 0220872.6, Mar. 13, 2003.
Examination Report to Application GB 0220872.6, Oct. 29, 2004.
Search Report to Application No. GB 0225505.7, Mar. 5, 2003.
Search and Examination Report to Application No. GB 0225505.7, Jul. 1, 2003.
Examination Report to Application No. GB 0225505.7, Oct. 27, 2004.
Examination Report to Application No. GB 0225505.7, Feb. 15, 2005.
Examination Report to Application No. GB 0300085.8, Nov. 28, 2003.
Examination Report to Application No. GB 030086.6, Dec. 1, 2003.
Examination Report to Application No. GB 0306046.4, Sep. 10, 2004.
Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.
Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.
Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, Jun. 14, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Examination Report to Application No. GB 0310836.2, Aug. 7, 2003.
Examination Report to Application No. GB 0311596.1, May 18, 2004.
Search and Examination Report to Application No. GB 0313406.1, Sep. 3, 2003.
Examination Report to Application No. GB 0314846.7, Jul. 15, 2004.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316886.1, Nov. 25, 2003.
Search and Examination Report to Application No. GB 0316887.9, Aug. 14, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0400018.8; Oct. 29, 2004.
Search and Examination Report to Application No. GB 0400018.8; May 17, 2005.
Examination Report to Application No. GB 0400019.6; Oct. 29, 2004.
Examination Report to Application No. GB 0400019.6; May 19, 2005.

Search and Examination Report to Application No. GB 0403891.5, Jun. 9, 2004.
Examination Report to Application No. GB 0403891.5, Feb. 14, 2005.
Examination Report to Application No. GB 0403891.5, Jun. 30, 2005.
Search and Examination Report to Application No. GB 0403893.1, Jun. 9, 2004.
Examination Report to Application No. GB 0403893.1, Feb. 14, 2005.
Search and Examination Report to Application No. GB 0403894.9, Jun. 9, 2004.
Examination Report to Application No. GB 0403894.9, Feb. 15, 2005.
Search and Examination Report to Application No. GB 0403897.2, Jun. 9, 2004.
Search and Examination Report to Application No. GB 0403920.2, Jun. 10, 2004.
Examination Report to Application No. GB 0403920.2, Feb. 15, 2005.
Search and Examination Report to Application No. GB 0403921.0, Jun. 10, 2004.
Examination Report to Application No. GB 0403921.0, Feb. 15, 2005.
Search and Examination Report to Application No. GB 0403926.9, Jun. 10, 2004.
Examination Report to Application No. GB 0404796.5; Apr. 14, 2005.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406257.6, Jan. 25, 2005.
Examination Report to Application No. GB 0406257.6 Jun. 16, 2005.
Examination Report to Application No. GB 0406258.4, May 20, 2004.
Examination Report to Application No. GB 0406258.4; Jan. 12, 2005.
Examination Report to Application No. GB 0408672.4, Mar. 21, 2005.
Examination Report to Application No. GB 0404830.2, Aug. 17, 2004.
Search and Examination Report to Application No. GB 0411698.4, Jun. 30, 2004.
Examination Report to Application No. GB 0411698.4, Jan. 24, 2005.
Search and Examination Report to Application No. GB 0411892.3, Jul. 14, 2004.
Examination Report to Application No. GB 0411892.3, Feb. 21, 2005.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Examination Report to Application No. GB 0412533.2, May 20, 2005.
Search Report to Application No. GB 0415835.8, Dec. 2, 2004.
Search Report to Application No. GB 0415835.8; Mar. 10, 2005.
Examination Report to Application No. 0416625.2 Jan. 20, 2005.
Search and Examination Report to Application No. GB 0416834.0, Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.

Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Search and Examination Report to Application No. GB 0507979.3 Jun. 16, 2005.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.

* cited by examiner

*Typical 3-D Surface View of the Conventional D2 Steel Cone after Multiple Expansion of the 1-5/8" Pipe*

Fig. 32a
Fig. 32c
*Typical 3-D Surface View of the Used Advanced DC53 Steel Cone with Phygen Film and REM Polishing*
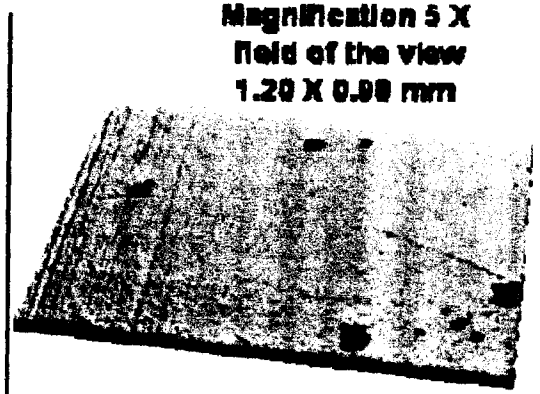
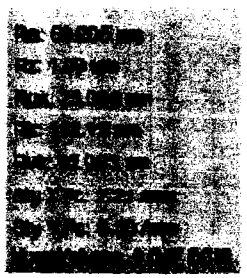
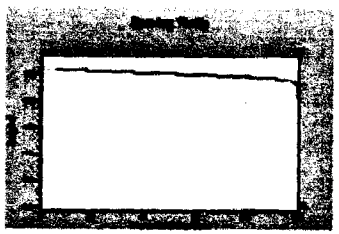
Fig. 32b
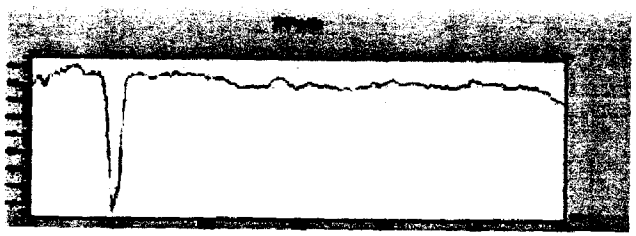
Fig. 32d

LUBRICATION SYSTEM FOR RADIALLY EXPANDING TUBULAR MEMBERS

CROSS REFERENCE TO RELATED APPLICATIONS

The present application claims the benefit of the filing date of U.S. provisional patent application Ser. No. 60/442,938, filed on Jan. 27, 2003, the disclosure of which is incorporated herein by reference.

The present application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671,filed on Nov. 1, 1999, (12) U.S. provisional patent application Ser. No. 60/154,047, filed on Sep. 16, 1999, (13) U.S. provisional patent application Ser. No. 60/159,082, filed on 10/12/1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001, (31) U.S. provisional patent application Ser. No. 60/343,674, filed on Dec. 27, 2001; and (32) U.S. provisional patent application Ser. No. 60/346,309, filed on Jan. 7, 2002, the disclosures of which are incorporated herein by reference.

BACKGROUND OF THE INVENTION

This invention relates generally to oil and gas exploration, and in particular to forming and repairing wellbore casings to facilitate oil and gas exploration.

During oil exploration, a wellbore typically traverses a number of zones within a subterranean formation. Wellbore casings are then formed in the wellbore by radially expanding and plastically deforming tubular members that are coupled to one another by threaded connections. Existing methods for radially expanding and plastically deforming tubular members coupled to one another by threaded connections are not always reliable or produce satisfactory results. In particular, the threaded connections can be damaged during the radial expansion process.

During expansion, an expansion cone is moved axially through the tubular members. The cone has an outside diameter greater than the inside diameter of the tubular members. Thus, a tremendous amount of friction exists between the con and the tubular members which results in heat, stress and wear.

The expansion cone, or mandrel, is used to permanently mechanically deform the pipe. The cone is moved through the tubing by a differential hydraulic pressure across the con itself, and/or by a direct mechanical pull or push force. The differential pressure is pumped through an inner-string connected to the cone, and the mechanical force is applied by either raising or lowering the inner string.

Progress of the cone through the tubing deforms the steel beyond its plastic limit into the plastic region, while keeping stresses below ultimate yield.

Contact between cylindrical mandrel and pipe ID during expansion leads to significant forces due to friction. It would be beneficial to provide a mandrel which could reduce friction during the expansion process.

The present invention is directed to overcoming one or more of the limitations of the existing processes for radially expanding and plastically deforming tubular members coupled to one another by threaded connections.

SUMMARY OF THE INVENTION

According to one aspect of the present invention, an expansion cone for radially expanding multiple tubular members is provided that includes a body having an annular outer peripheral surface, and at least a portion of the surface being textured with friction reducing reliefs recessed into the surface.

According to another aspect of the present invention, a reduced friction radial expansion apparatus is provided that includes a plurality of tubular members having an axial passage formed therethrough including an inside diameter, an expansion cone having an annular outer peripheral surface including an outside diameter greater than the inside diameter of the axial passage, and at least a portion of the outer peripheral surface being textured with friction reducing reliefs recessed into the surface.

According to another aspect of the present invention, an apparatus for radially expanding and plastically deforming a tubular member is provided that includes a support member, an expansion device coupled to an end of the support member comprising one or more expansion surfaces for engaging the tubular member during the radial expansion and plastic deformation of the tubular member, and a lubrication system for lubricating an interface between one or more of the expansion surfaces of the expansion device and one or more interior surfaces of the tubular member.

According to another aspect of the present invention, a method for radially expanding and plastically deforming a tubular member is provided that includes radially expanding and plastically deforming the tubular member using an expansion device comprising one or more expansion surfaces, and lubricating an interface between one or more of the expansion surfaces of the expansion device and one or more interior surfaces of the tubular member.

According to another aspect of the present invention, a system for lubricating an interface between an expansion device and a tubular member during a radial expansion of the tubular member by the expansion device is provided that includes means for supplying a quantity of a lubricant material, and means for injecting at least a portion of the lubricant material into the interface.

According to another aspect of the present invention, a method of operating a system for lubricating an interface between an expansion device and a tubular member during a radial expansion of the tubular member by the expansion device is provided that includes determining a rate of strain of the tubular member during an operation of the expansion device, and varying a concentration of a lubricant material within the interface during the operation of the expansion device as a function of the determined rate of strain.

According to another aspect of the present invention, a method of operating a system for lubricating an interface between an expansion device and a tubular member during a radial expansion of the tubular member by the expansion device is provided that includes determining one or more characteristics of the interface during an operation of the expansion device, and varying a concentration of a lubricant material within the interface during the operation of the expansion device as a function of one or more of the determined characteristics.

According to another aspect of the present invention, a system for lubricating an interface between an expansion device and a tubular member during a radial expansion of the tubular member by the expansion device is provided that includes means for determining a rate of strain of the tubular member during an operation of the expansion device, and means for varying a concentration of a lubricant material within the interface during the operation of the expansion device as a function of the determined rate of strain.

According to another aspect of the present invention, a system for lubricating an interface between an expansion device and a tubular member during a radial expansion of the tubular member by the expansion device is provided that includes means for determining on or more characteristics of the interface during an operation of the expansion device, and means for varying a concentration of a lubricant material within the interface during the operation of the expansion device as a function of one or more of the determined characteristics.

According to another aspect of the present invention, a method of operating a system for lubricating an interface between an expansion device and a tubular member during a radial expansion of the tubular member by the expansion device is provided that includes determining one or more characteristics of the operation of the expansion device, and varying a concentration of a lubricant material within the interface during the operation of the expansion device as a function of one or more of the determined characteristics.

According to another aspect of the present invention, a system for lubricating an interface between an expansion device and a tubular member during a radial expansion of the tubular member by the expansion device is provided that includes means for determining one or more characteristics of the operation of the expansion device, and means for varying a concentration of a lubricant material within the interface during the operation of the expansion device as a function of one or more of the determined characteristics.

According to another aspect of the present invention, a tribological system for lubricating an interface between an expansion device and a tubular member during a radial expansion and plastic deformation of the tubular member is provided that includes an expansion surface coupled to the expansion device defining a surface texture, a first lubricating film coupled to the expansion surface, a second lubricating film coupled to an interior surface of the tubular member, and a lubricating material disposed within an annulus defined between the expansion surface of the expansion device and the interior surface of the tubular member.

According to another aspect of the present invention, a method of lubricating an interface between an expansion surface of an expansion device and a tubular member during a radial expansion and plastic deformation of the tubular member is provided that includes texturing the expansion surface, coupling a first lubricating film coupled to the expansion surface, coupling a second lubricating film to an interior surface of the tubular member, and disposing a lubricating material within an annulus defined between the expansion surface of the expansion device and the interior surface of the tubular member.

According to another aspect of the present invention, a system for radially expanding and plastically deforming a tubular member is provided in which the amount of energy required to overcome frictional forces during the radial expansion and plastic deformation of the tubular member is less than or equal to 8% of the total amount of energy required to radially expand and plastically deform the tubular member.

According to another aspect of the present invention, a system for radially expanding and plastically deforming a tubular member is provided including an expansion device, wherein the coefficient of friction between the expansion device and the tubular member during the radial expansion and plastic deformation of the tubular member is less than or equal to 0.06.

BRIEF DESCRIPTION OF THE DRAWINGS

FIGS. 32*a*, 32*b*, 32*c*, and 32*d* are illustrations of an exemplary embodiment of the apparatus of FIGS. 1*a* and 1*b*.

DETAILED DESCRIPTION OF THE ILLUSTRATIVE EMBODIMENTS

Figure 1A:
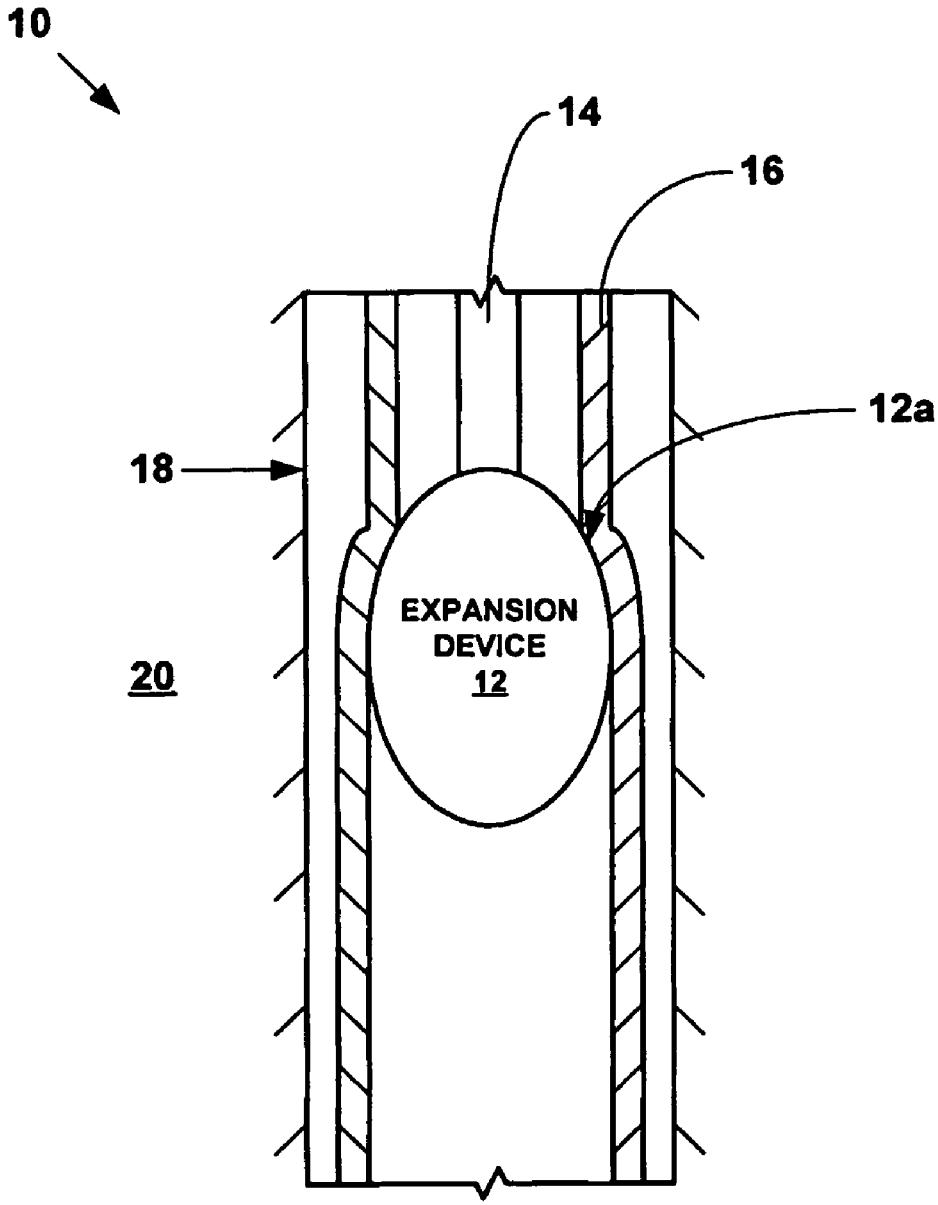
FIG. 1*a* is a fragmentary cross-sectional view illustrating an exemplary embodiment of an apparatus for radially expanding and plastically deforming a tubular member.
Figure 1B:
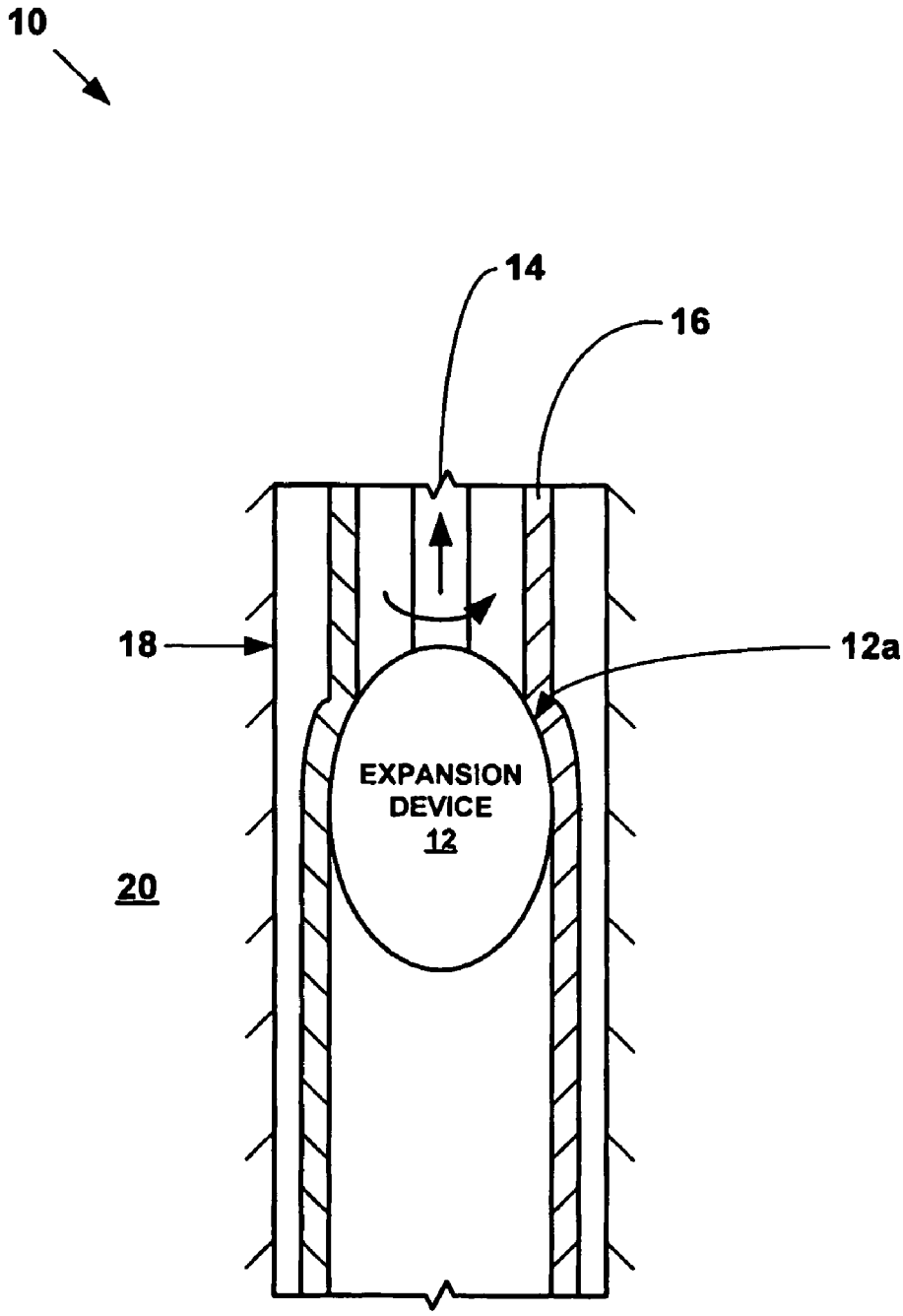
FIG. 1*b* is a fragmentary cross-sectional illustration of an exemplary embodiment of the operation of the apparatus of FIG. 1*a*.

Referring to FIGS. 1*a* and 1*b*, an exemplary embodiment of an apparatus 10 for radially expanding a tubular member includes an expansion device 12 including one or more expansion surfaces 12*a* that is coupled to an end of a support member 14.

In an exemplary embodiment, the expansion device 12 is a conventional commercially available expansion device and/or is provided substantially as described in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001, (31) U.S. provisional patent application Ser. No. 60/343,674, filed on Dec. 27, 2001; and (32) U.S. provisional patent application Ser. No. 60/346,309, filed on Jan. 7, 2002, the disclosures of which are incorporated herein by reference. In several alternative embodiments, the expansion device 12 is, or includes, a conventional commercially available rotary expansion device such, for example, those available from Weatherford International.

In an exemplary embodiment, the apparatus 10 is operated to radially expand and plastically deform a tubular member 16 by displacing and/or rotating the expansion device 12 relative to the tubular member 16 within a preexisting structure such as, for example, a wellbore 18 that traverses a subterranean formation 20. In an exemplary embodiment, during the operation of the apparatus 10, the expansion surface 12*a* of the expansion device 12 engages at least a portion of the interior surface 16*a* of the tubular member 16.

In an exemplary embodiment, the apparatus 10 is operated substantially as described in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001, (31) U.S. provisional patent application Ser. No. 60/343,674, filed on Dec. 27, 2001; and (32) U.S. provisional patent application Ser. No. 60/346,309, filed on Jan. 07, 2002, the disclosures of which are incorporated herein by reference. In several alternative embodiments, the expansion device 12 is operated like, or includes operational features of, a conventional commercially available rotary expansion device such, for example, those available from Weatherford International.

Figure 2:
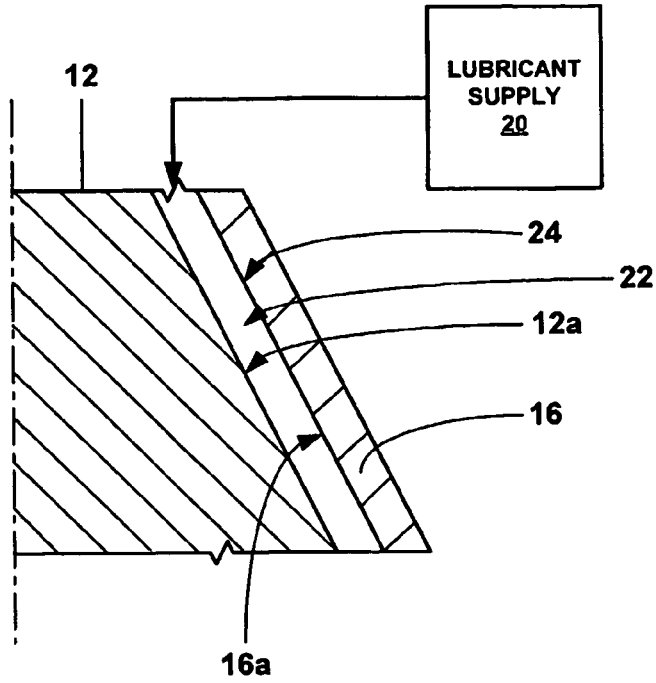
FIG. 2 is a fragmentary cross-sectional illustration of an exemplary embodiment of the apparatus of FIGS. 1*a* and 1*b* including a lubricant supply.

In an exemplary embodiment, as illustrated in FIG. 2, the apparatus 10 further includes a lubricant supply 20, and during the operation of the apparatus 10, the lubricant supply injects a lubricating material 22 into an annulus 24 defined between one or more the expansion surfaces 12*a* of the expansion device 12 and the internal surface 16*a* of the tubular member 16. In this manner, the amount of energy and/or power required to radially expand and plastically deform the tubular member 16 using the expansion device 12 is reduced. In an exemplary embodiment, the lubricating material 22 includes fluidic and/or solid lubricating materials.

Figure 3:
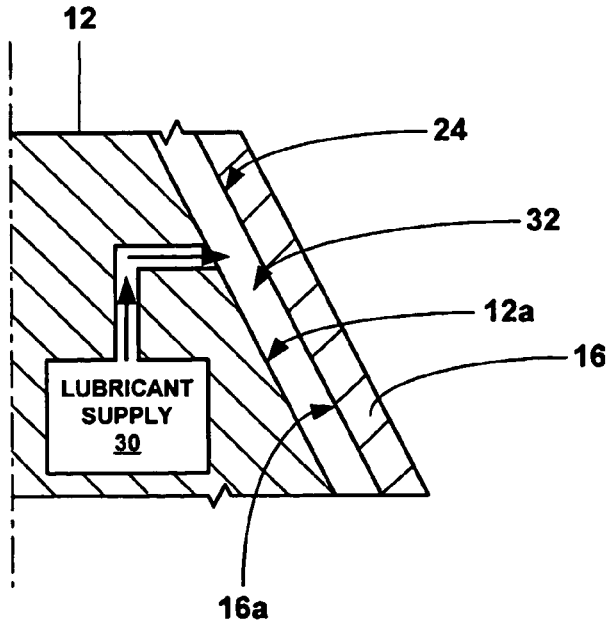
FIG. 3 is a fragmentary cross-sectional illustration of an exemplary embodiment of the apparatus of FIGS. 1*a* and 1*b* including a lubricant supply.

In an exemplary embodiment, as illustrated in FIG. 3, the expansion device 12 of the apparatus 10 further includes an internal lubricant supply 30, and during the operation of the apparatus 10, the lubricant supply injects a lubricating material 32 into the annulus 24. In this manner, the amount of energy and/or power required to radially expand and plastically deform the tubular member 16 using the expansion device 12 is reduced. In an exemplary embodiment, the lubricating material 32 includes fluidic and/or solid lubricating materials. In an exemplary embodiment, the lubricant supply injects the lubricating material 32 into one or more recesses defined in the expansion surface 12*a* of the expansion device 12.

Figure 4:
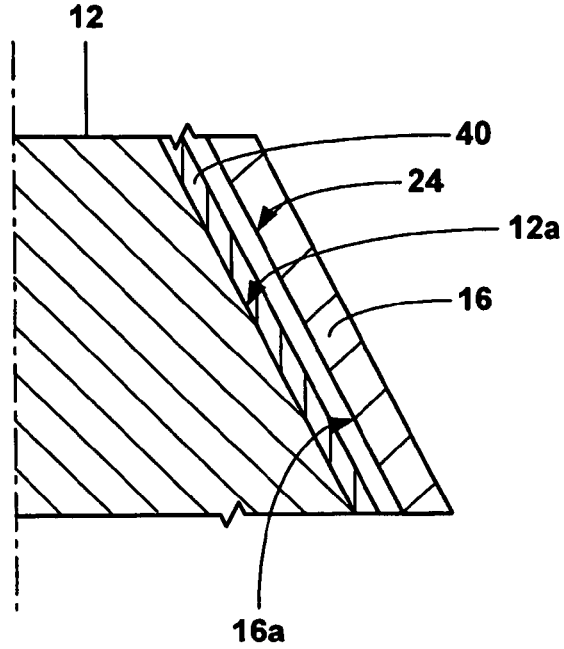
FIG. 4 is a fragmentary cross-sectional illustration of an exemplary embodiment of the apparatus of FIGS. 1*a* and 1*b* including a lubricant coating.

In an exemplary embodiment, as illustrated in FIG. 4, a layer of a lubricating film 40 is coupled to at least a portion of one or more of the expansion surfaces 12*a* of the expansion device 12 of the apparatus 10 such that, during the operation of the apparatus, at least a portion of the lubricating film 40 is released into the annulus 24. In this manner, the amount of energy and/or power required to radially expand and plastically deform the tubular member 16 using the expansion device 12 is reduced.

In an exemplary embodiment, the lubricating film 40 includes fluidic and/or solid lubricating materials. In an exemplary embodiment, the thickness and/or composition of the film 40 are non-uniform.

Figure 5:
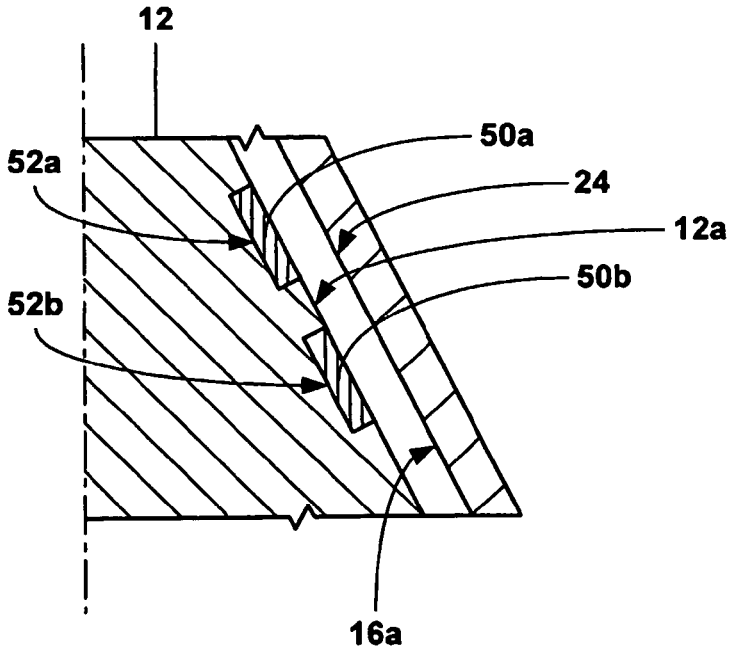
FIG. 5 is a fragmentary cross-sectional illustration of an exemplary embodiment of the apparatus of FIGS. 1*a* and 1*b* including a lubricant coating.

In an exemplary embodiment, as illustrated in FIG. 5, layers 50*a* and 50*b* of a lubricating film are coupled to portions of one or more of the expansion surfaces 12*a* of the expansion device 12 of the apparatus 10 such that, during the operation of the apparatus, at least a portion of the layers of lubricating film, 50*a* and 50*b*, are released into the annulus 24. In this manner, the amount of energy and/or power required to radially expand and plastically deform the tubular member 16 using the expansion device 12 is reduced. In an exemplary embodiment, the layers, 50*a* and 50*b*, of lubricating film are deposited within recesses, 52*a* and 52*b*, respectively, defined within the expansion surface 12*a*. In an exemplary embodiment, the lubricating film, 50*a* and 50*b*, include fluidic and/or solid lubricating materials. In an exemplary embodiment, the thickness and/or composition of the films, 50*a* and/or 50*b*, are non-uniform.

Figure 6:
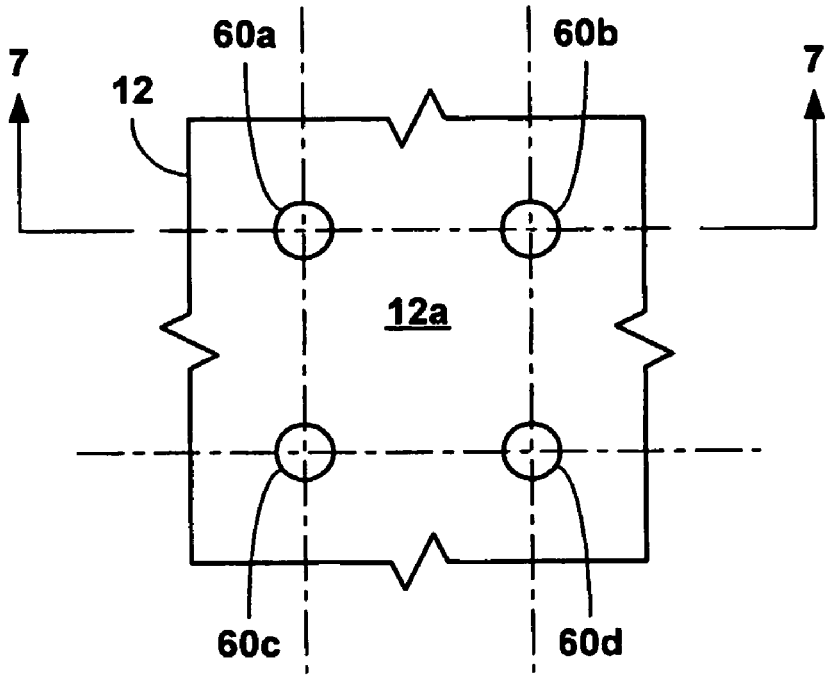
FIG. 6 is a fragmentary cross-sectional illustration of an exemplary embodiment of an exemplary portion of the external surface of the expansion device of the apparatus of FIGS. 1*a* and 1*b* including one or more recesses defined in the external surface.
Figure 7:
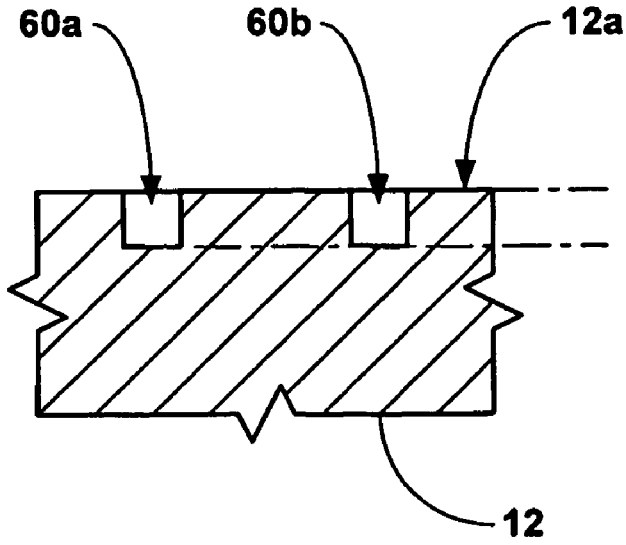
FIG. 7 is a fragmentary cross-sectional illustration of an exemplary embodiment of the apparatus of FIG. 6.

In an exemplary embodiment, as illustrated in FIGS. 6 and 7, one or more portions of the expansion surfaces 12*a* of the apparatus 10 define recesses 60*a*, 60*b*, 60*c*, and 60*d*, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recesses, 60*a*, 60*b*, 60*c*, and 60*d*, are substantially identical and equally spaced cylindrical cavities defined within the expansion surface 12*a* of the expansion device. In several alternative embodiments, one or more of the recesses 60 may be different in geometry from one or more of the other recesses 60. In several alternative embodiments, the spacing between the recesses 60 may be unequal.

Figure 8:
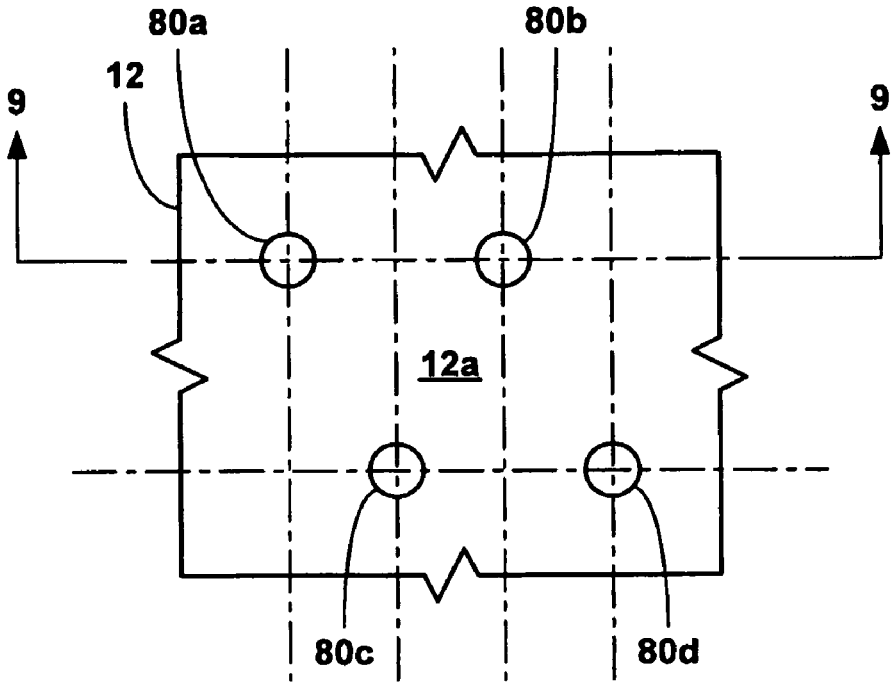
FIG. 8 is a fragmentary cross-sectional illustration of an exemplary embodiment of an exemplary portion of the external surface of the expansion device of the apparatus of FIGS. 1*a* and 1*b* including on or more recesses defined in the external surface.
Figure 9:
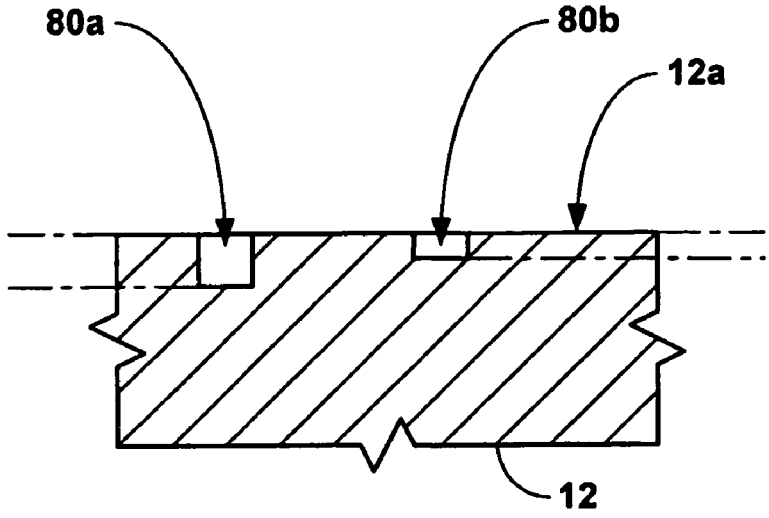
FIG. 9 is a fragmentary cross-sectional illustration of an exemplary embodiment of the apparatus of FIG. 8.

In an exemplary embodiment, as illustrated in FIGS. 8 and 9, one or more portions of the expansion surfaces 12*a* of the apparatus 10 define recesses 80*a*, 80*b*, 80*c*, and 80*d*, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recesses, 80*a*, 80*b*, 80*c*, and 80*d*, are cylindrical cavities of varying depths defined within the expansion surface 12*a* of the expansion device. In an exemplary embodiment, the placement of the recesses 80 is such that the pair of recesses, 80*a* and 80*b*, are offset from the other pair of recesses, 80*c* and 80*d*. In several alternative embodiments, one or more of the recesses 80 may be different in geometry from one or more of the other recesses 80. In several alternative embodiments, the spacing between the recesses 80 may be unequal.

Figure 10:
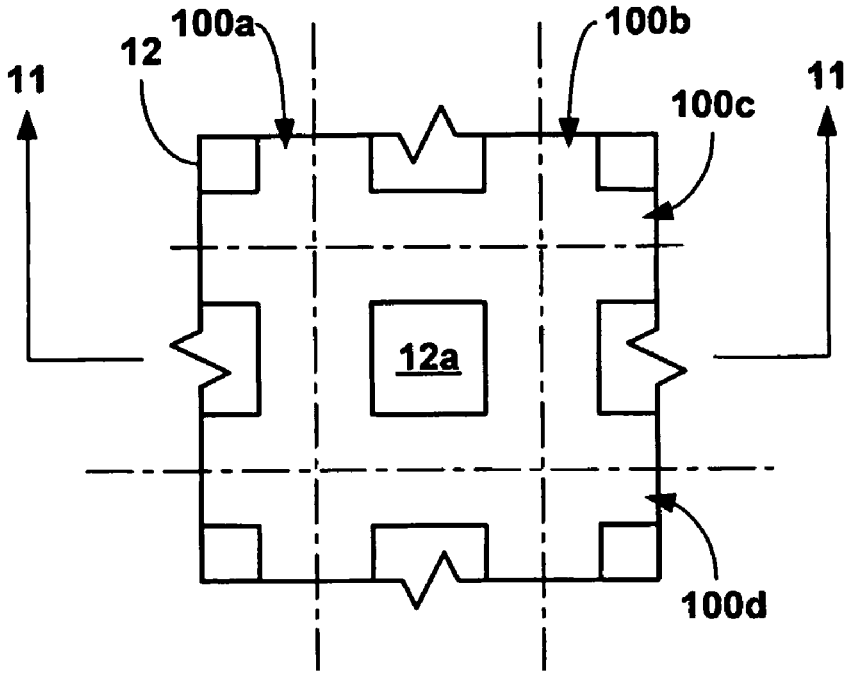
FIG. 10 is a fragmentary cross-sectional illustration of an exemplary embodiment of an exemplary portion of the external surface of the expansion device of the apparatus of FIGS. 1*a* and 1*b* including one or more recesses defined in the external surface.
Figure 11:
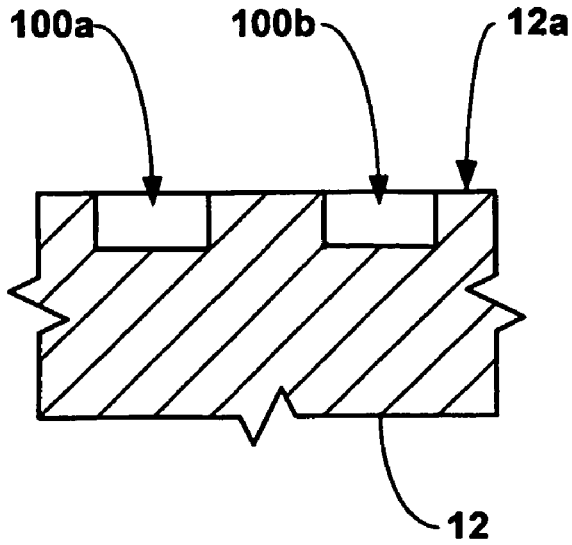
FIG. 11 is a fragmentary cross-sectional illustration of an exemplary embodiment of the apparatus of FIG. 10.

In an exemplary embodiment, as illustrated in FIGS. 10 and 11, one or more portions of the expansion surfaces 12*a* of the apparatus 10 define criss-crossing recesses 100*a*, 100*b*, 100*c*, and 100*d*, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recesses, 100*a* and 100*b*, are substantially parallel to one another, and the recesses, 100*c* and 100*d*, are substantially parallel to one another, and the recesses, 100*a* and 100*b*, are both substantially orthogonal to the recesses, 100*c* and 100*d*. In several alternative embodiments, one or more of the recesses 100 may be different in geometry and orientation from one or more of the other recesses 100. In several alternative embodiments, the spacing between the recesses 100 may be unequal.

Figure 12:
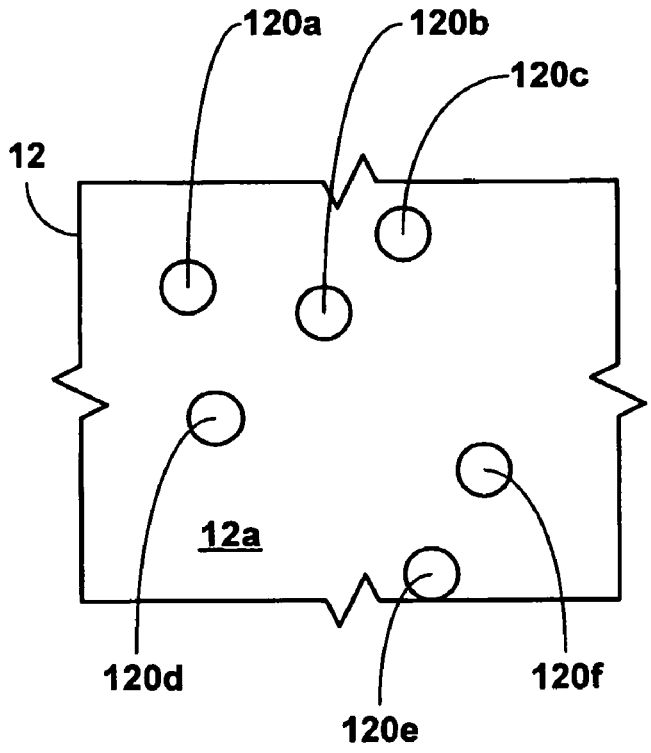
FIG. 12 is a fragmentary cross-sectional illustration of an exemplary embodiment of an exemplary portion of the external surface of the expansion device of the apparatus of FIGS. 1*a* and 1*b* including one or more recesses defined in the external surface.

In an exemplary embodiment, as illustrated in FIG. 12, one or more portions of the expansion surfaces 12*a* of the apparatus 10 define recesses 120*a*, 120*b*, 120*c*, 120*d*, 120*e* and 120*f*, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recesses 120 are substantially identical cylindrical recesses that are defined within, and randomly distributed on, the expansion surface 12*a* of the expansion device 12. In several alternative embodiments, one or more of the recesses 120 may be different in geometry and orientation from one or more of the other recesses 120.

Figure 13:
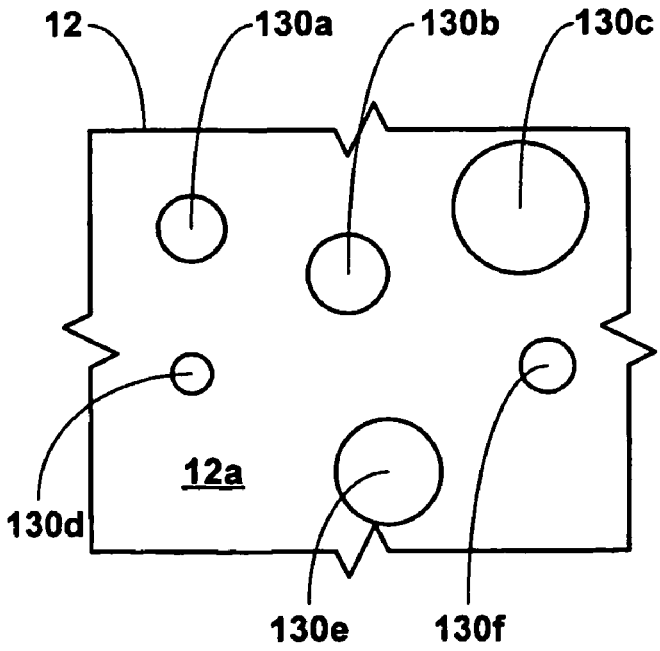
FIG. 13 is a fragmentary cross-sectional illustration of an exemplary embodiment of the apparatus of FIG. 12.

In an exemplary embodiment, as illustrated in FIG. 13, one or more portions of the expansion surfaces 12*a* of the apparatus 10 define recesses 130*a*, 130*b*, 130*c*, 130*d*, 130*e* and 130*f*, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recesses 130 are cylindrical recesses that are defined within, and randomly distributed on, the expansion surface 12*a* of the expansion device 12. In an exemplary embodiment, the volumetric geometry of the recesses 130 are randomly selected.

Figure 14:
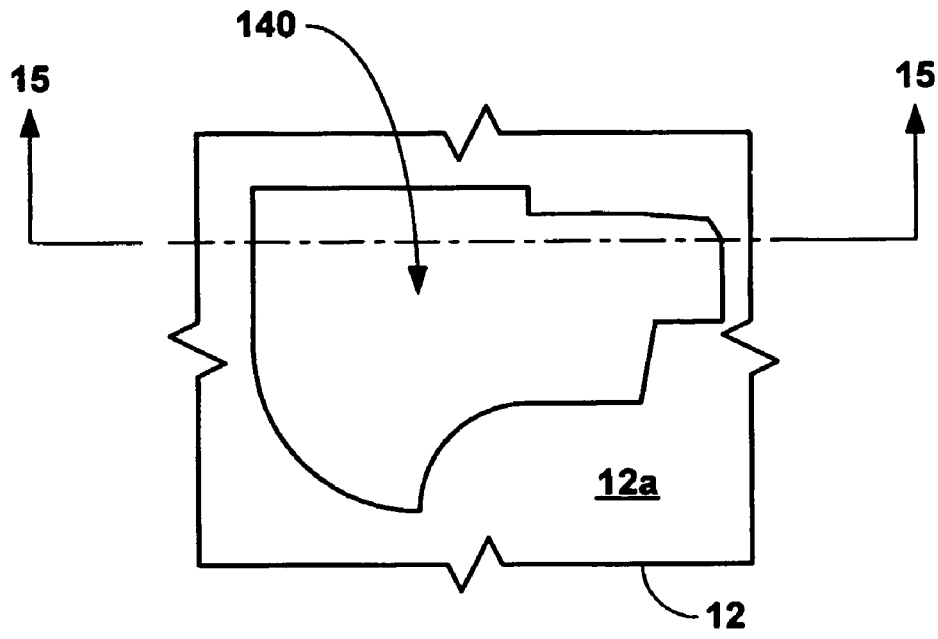
FIG. 14 is a fragmentary cross-sectional illustration of an exemplary embodiment of an exemplary portion of the external surface of the expansion device of the apparatus of FIGS. 1*a* and 1*b* including one or more recesses defined in the external surface.
Figure 15:
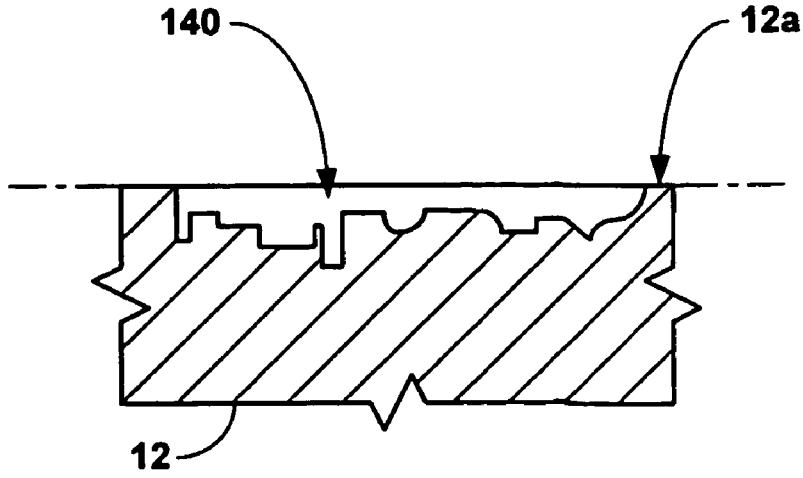
FIG. 15 is a fragmentary cross-sectional illustration of an exemplary embodiment of the apparatus of FIG. 14.

In an exemplary embodiment, as illustrated in FIGS. 14 and 15, one or more portions of the expansion surfaces 12*a* of the apparatus 10 define one or more recesses 140, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the boundaries of the recess 140 include one or more linear and/or non-linear boundaries and the depth of the recess is random in all directions. In several alternative embodiments, one or more of the recesses 140 may be different in geometry and orientation from one or more of the other recesses 140. In several alternative embodiments, the spacing between the recesses 140 may be unequal and/or random. In several alternative embodiments, the depth of the recess 140 may be constant.

Figure 16:
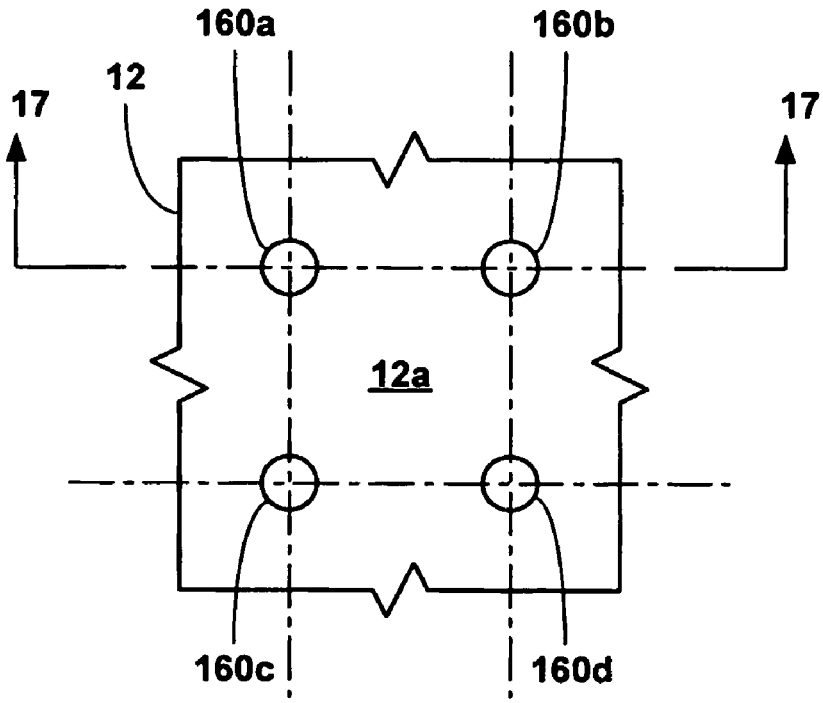
FIG. 16 is a fragmentary cross-sectional illustration of an exemplary embodiment of an exemplary portion of the external surface of the expansion device of the apparatus of FIGS. 1*a* and 1*b* including one or more recesses defined in the external surface.
Figure 17:
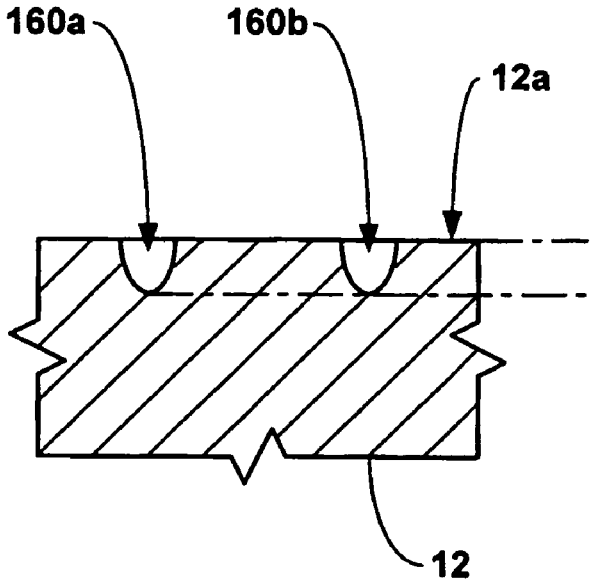
FIG. 17 is a fragmentary cross-sectional illustration of an exemplary embodiment of the apparatus of FIG. 16.

In an exemplary embodiment, as illustrated in FIGS. 16 and 17, one or more portions of the expansion surfaces 12*a* of the apparatus 10 define recesses 160*a*, 160*b*, 160*c*, and 160*d*, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recesses, 160*a*, 160*b*, 160*c*, and 160*d*, are substantially identical and equally spaced cylindrical cavities having completely curved walls defined within the expansion surface 12*a* of the expansion device. In several alternative embodiments, one or more of the recesses 160 are substantially identical in geometry to the dimples found in one or more conventional golf balls. In several alternative embodiments, one or more of the recesses 160 may be different in geometry from one or more of the other recesses 160. In several alternative embodiments, the spacing between the recesses 160 may be unequal.

Figure 18:
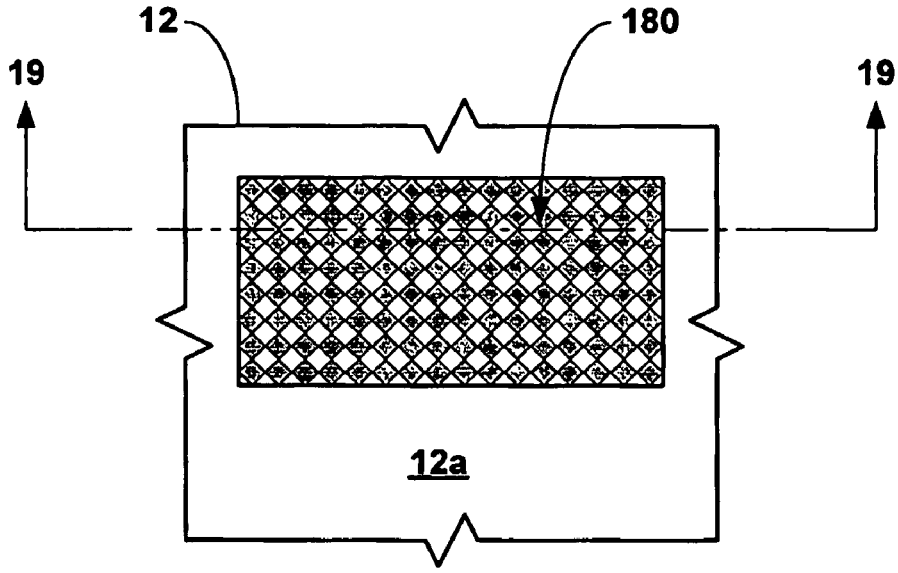
FIG. 18 is a fragmentary cross-sectional illustration of an exemplary embodiment of an exemplary portion of the external surface of the expansion device of the apparatus of FIGS. 1*a* and 1*b* including one or more recesses defined in the external surface.
Figure 19:
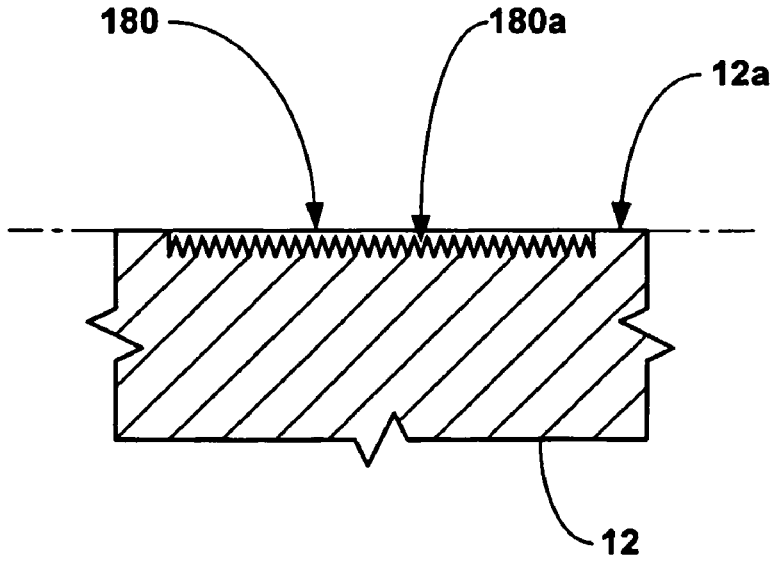
FIG. 19 is a fragmentary cross-sectional illustration of an exemplary embodiment of the apparatus of FIG. 18.

In an exemplary embodiment, as illustrated in FIGS. 18 and 19, one or more portions of the expansion surfaces 12*a* of the apparatus 10 define a recess 180, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recess 180 is an etched surface having a non-uniform pattern of pits 180*a*. In several alternative embodiments, the depth of the pits 180*a* is non-uniform.

Figure 20:
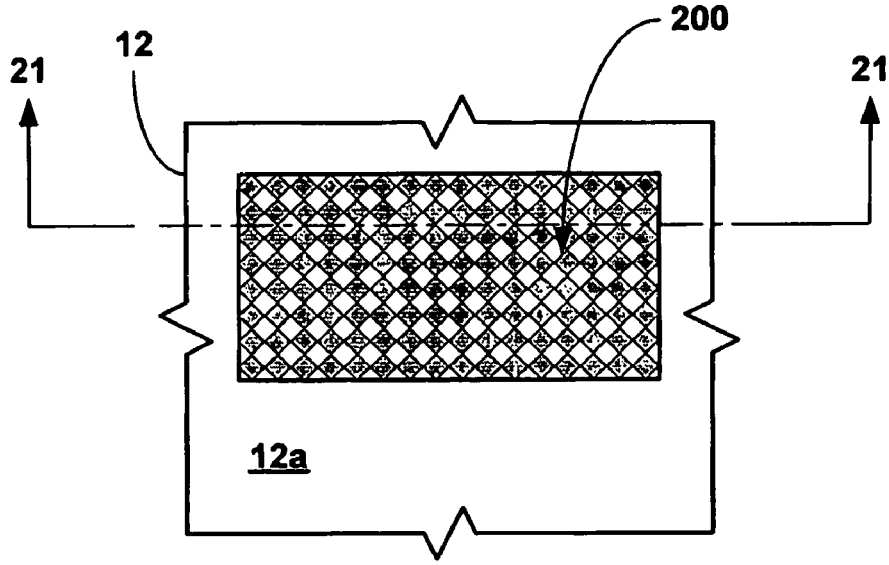
FIG. 20 is a fragmentary cross-sectional illustration of an exemplary embodiment of an exemplary portion of the external surface of the expansion device of the apparatus of FIGS. 1*a* and 1*b* including one or more recesses defined in the external surface.
Figure 21:
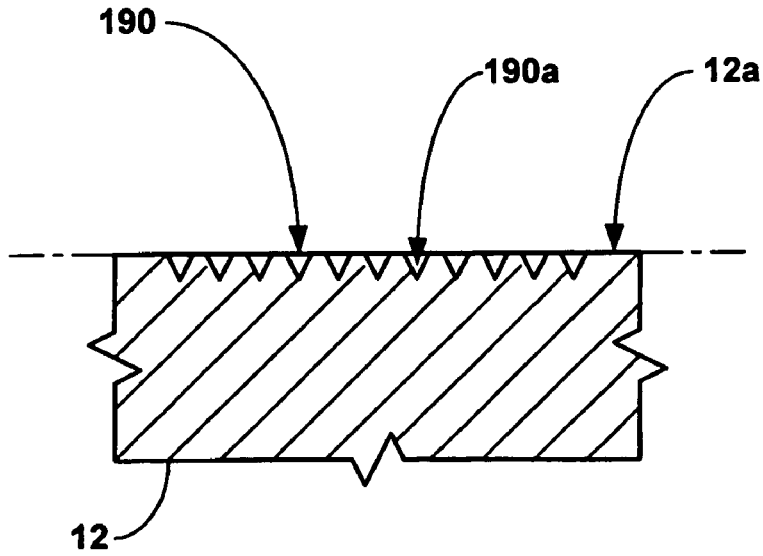
FIG. 21 is a fragmentary cross-sectional illustration of an exemplary embodiment of the apparatus of FIG. 20.

In an exemplary embodiment, as illustrated in FIGS. 20 and 21, one or more portions of the expansion surfaces 12*a* of the apparatus 10 define a recess 190, that may, for example, contain the lubricant material 22, the lubricant material 32, the lubricant film 40, and/or the lubricant film 50, such that, during the operation of the apparatus, at least a portion of the lubricant materials and/or the lubricant films are released into the annulus 24. In this manner, the amount of energy and/or power required to radially expand and plastically deform the tubular member 16 using the expansion device 12 is reduced. In an exemplary embodiment, the recess 190 is a knurled surface having a uniform pattern of pits 190*a*. In several alternative embodiments, the pattern of the pits 190*a* and/or the depth of the pits 190*a* is non-uniform.

Figure 22:
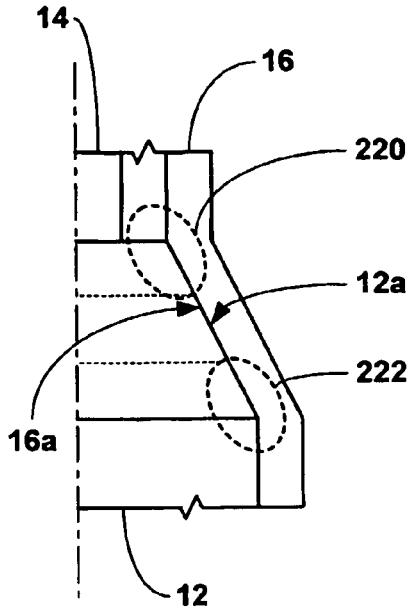
FIG. 22 is a fragmentary cross-sectional illustration of an exemplary embodiment of leading and trailing edges of the interface between the expansion device of the apparatus of FIGS. 1*a* and 1*b* and the tubular member during the radial expansion and plastic deformation of the tubular member.
Figure 23:
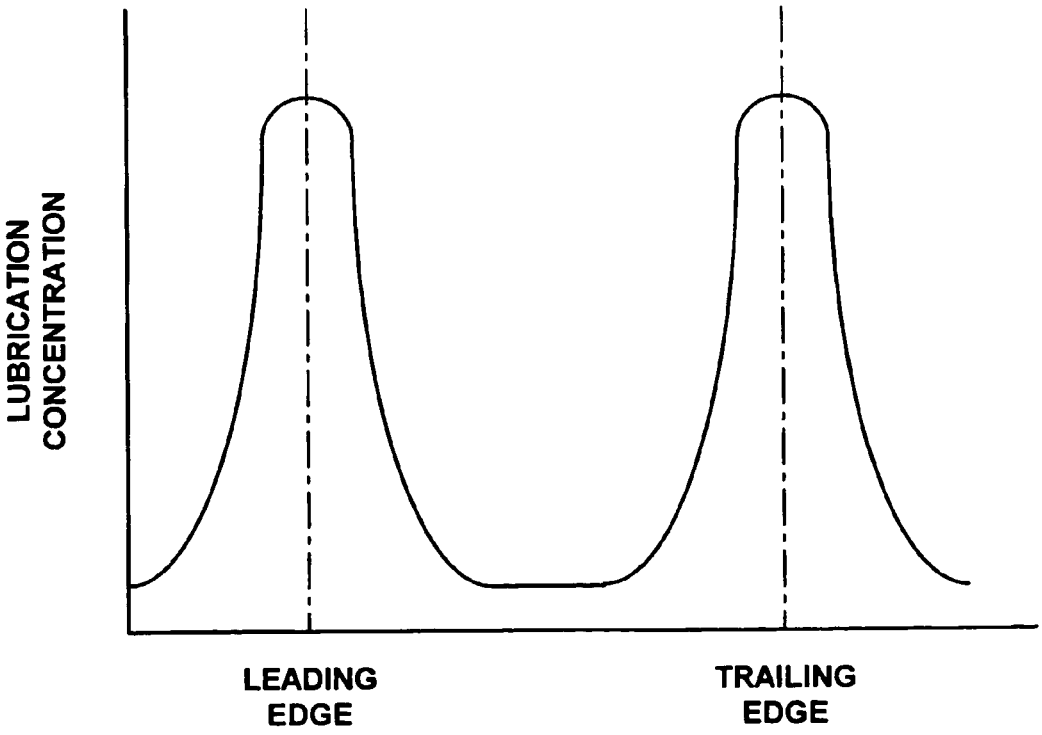
FIG. 23 is an exemplary embodiment of a graphical illustration of the concentration distribution of lubrication elements in the external surface of the expansion device of the apparatus of FIGS. 1*a* and 1*b*.

In an exemplary embodiment, as illustrated in FIG. 22, during the operation of the apparatus 10, the interface between the expansion surface 12*a* of the expansion device 12 and the interior surface 16*a* of the tubular member 16 includes a leading edge portion 220 and a trailing edge portion 222. In an exemplary embodiment, as illustrated in FIG. 23, the concentration of lubrication is increased in the leading and trailing edge portions, 220 and 222, respectively, in order to reduce the amount of energy and/or power required to radially expand and plastically deform the tubular member 16 using the expansion device 12.

In several exemplary embodiments, the concentration of lubrication within a specific portions of the expansion surface 12*a* of the expansion device 12 is increased by increasing one or more of the following: 1) the flow of the lubricant materials 22 and/or 32 into the annulus 24 surrounding the specific portion; 2) the volume of the films 40 and/or 50 applied to the specific portion; 3) the density of the recesses 60, 80, 100, 120, 130, 140, 160, 180, and/or 200 within the specific portion; and/or 4) the normalized oil volume within the specific portion.

Figure 24:
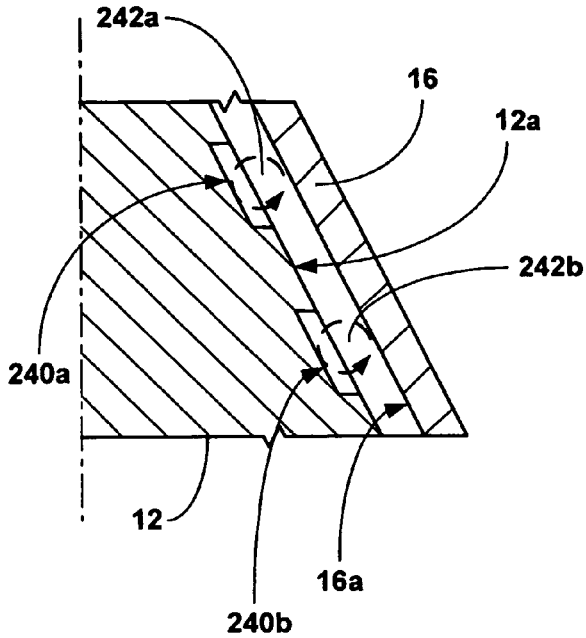
FIG. 24 is a fragmentary cross-sectional illustration of an exemplary embodiment of the interface between the expansion device of the apparatus of FIGS. 1*a* and 1*b* and the tubular member during the radial expansion and plastic deformation of the tubular member.

In an exemplary embodiment, as illustrated in FIG. 24, during the operation of the apparatus 10, recesses, 240*a* and 240*b*, defined within the expansion surface 12*a* of the expansion device 12, provide a support for, and define lubrication ball bearings, 242*a* and 242*b*, for lubricating the interface between the expansion surface of the expansion device and the internal surface 16*a* of the tubular member. In this manner, the lubricating materials derived from one or more of the following: the lubricant materials 22 and/or 32 and/or the films 40 and/or 50 are formed into a ball-like fluidic lubricating structure that act like lubricating ball bearings thereby reducing the amount of energy and/or power required to radially expand and plastically deform the tubular member 16 using the expansion device 12.

Figure 25:
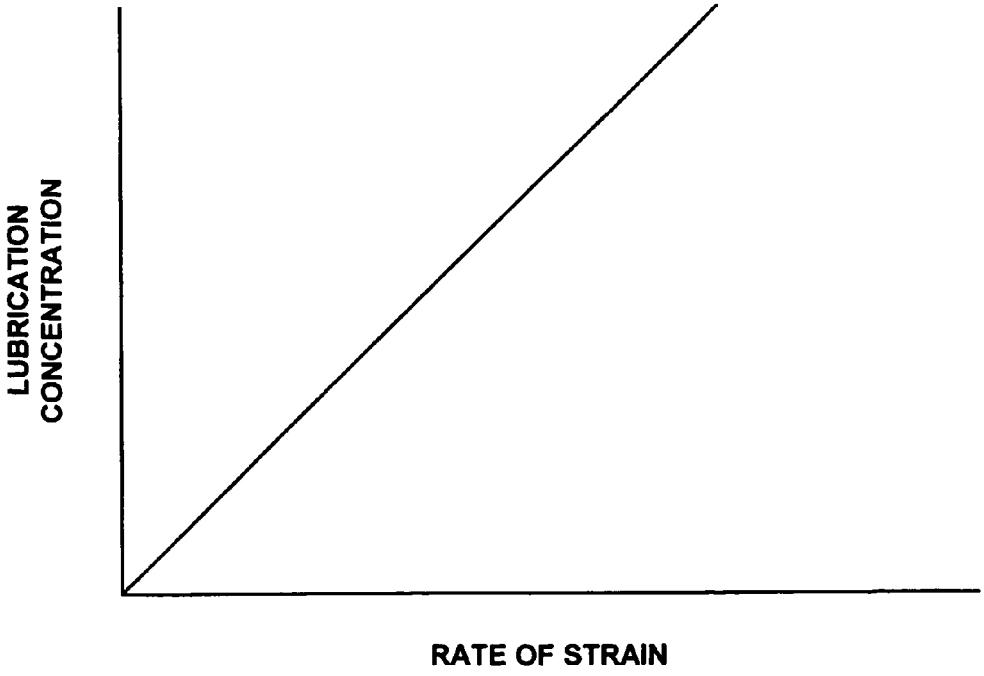
FIG. 25 is an exemplary embodiment of a graphical illustration of the concentration distribution of lubrication elements in the external surface of the expansion device of the apparatus of FIGS. 1*a* and 1*b*.
Figure 26:
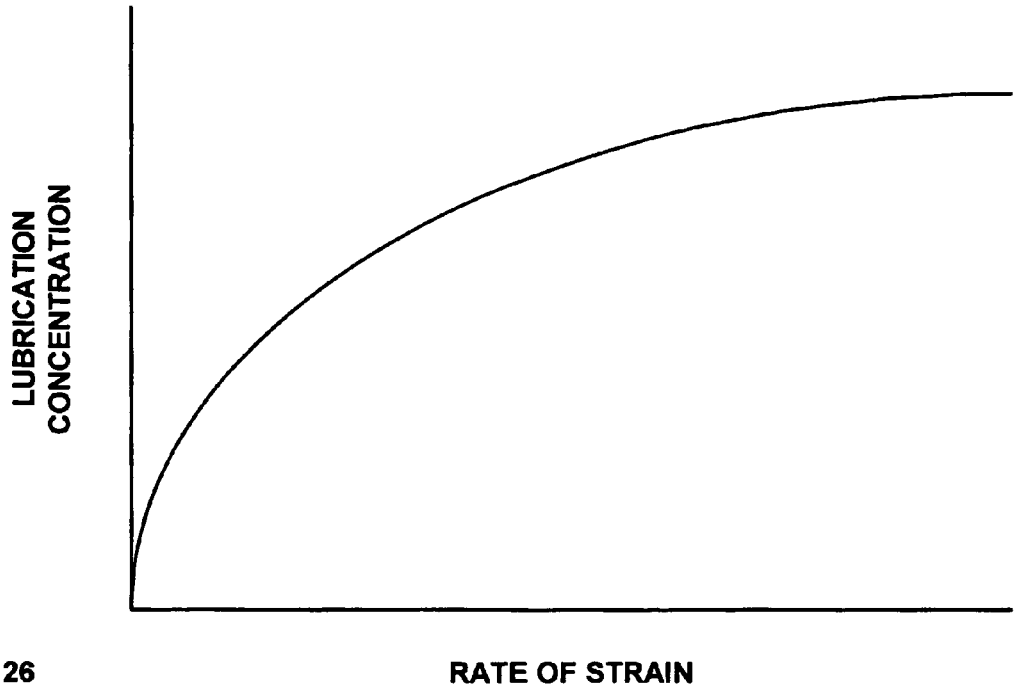
FIG. 26 is an exemplary embodiment of a graphical illustration of the concentration distribution of lubrication elements in the external surface of the expansion device of the apparatus of FIGS. 1*a* and 1*b*.
Figure 27:
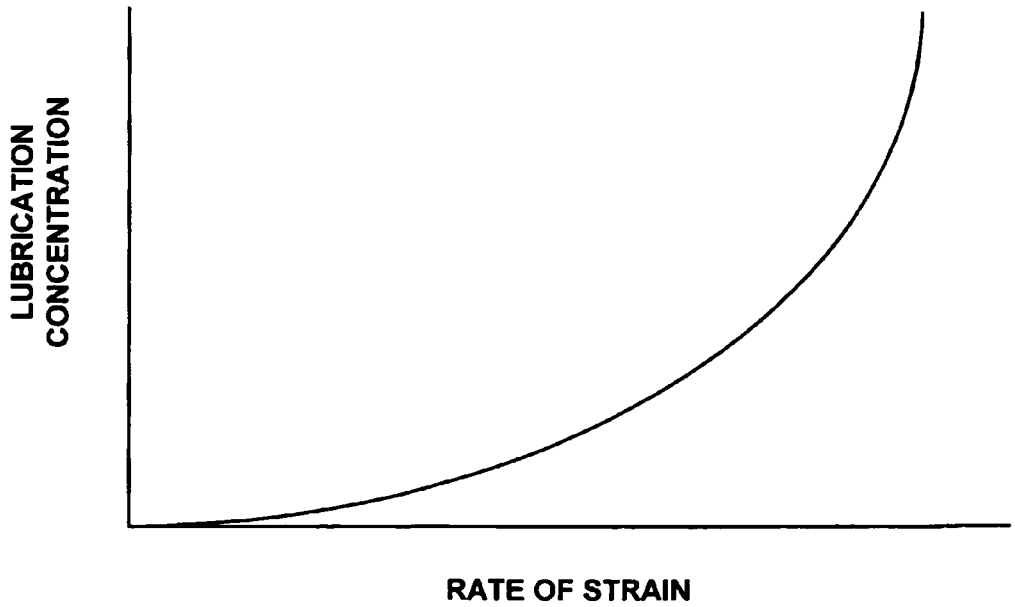
FIG. 27 is an exemplary embodiment of a graphical illustration of the concentration distribution of lubrication elements in the external surface of the expansion device of the apparatus of FIGS. 1*a* and 1*b*.
Figure 28:
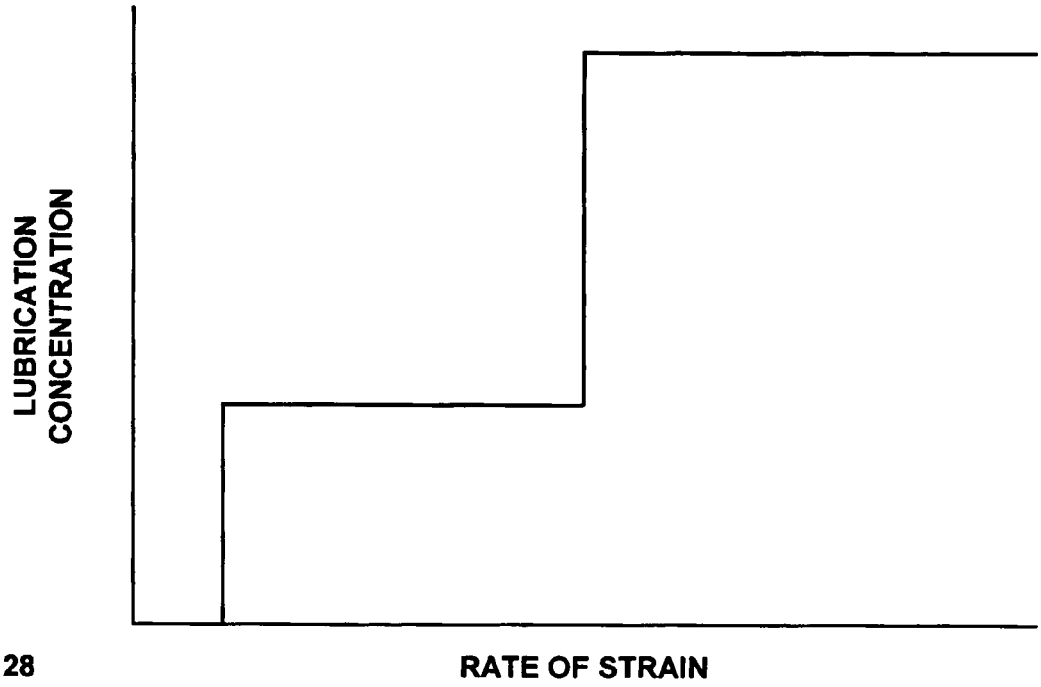
FIG. 28 is an exemplary embodiment of a graphical illustration of the concentration distribution of lubrication elements in the external surface of the expansion device of the apparatus of FIGS. 1*a* and 1*b*.
Figure 29:
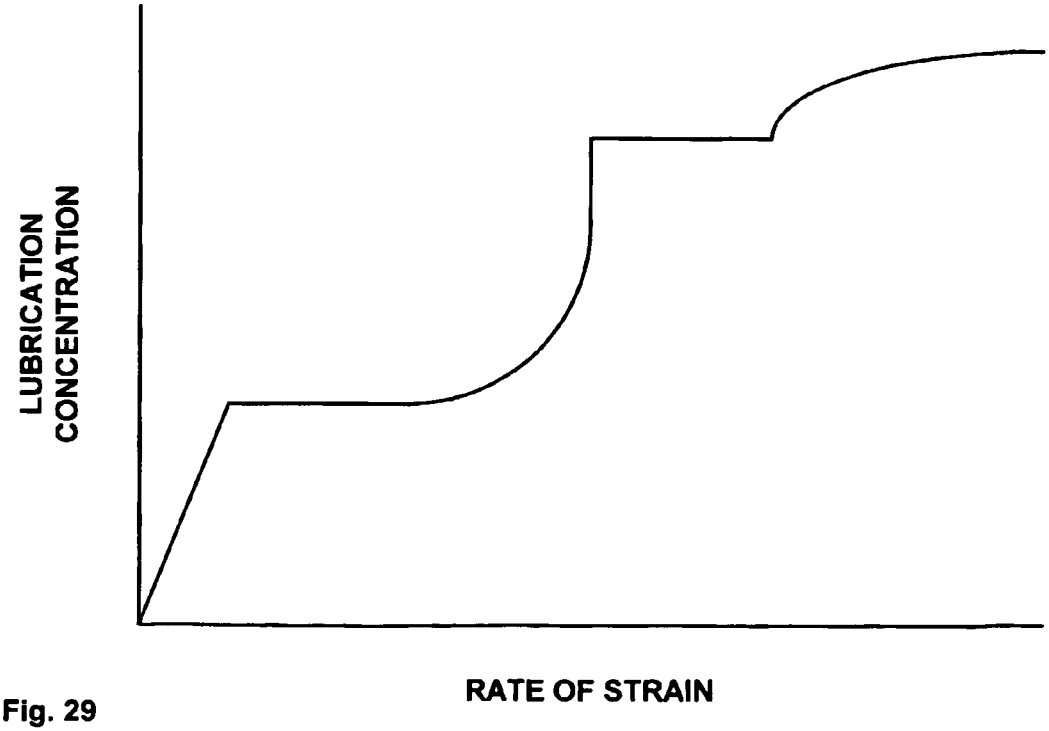
FIG. 29 is an exemplary embodiment of a graphical illustration of the concentration distribution of lubrication elements in the external surface of the expansion device of the apparatus of FIGS. 1*a* and 1*b*.

In an exemplary embodiment, during the operation of the apparatus 10, the rate of strain of the tubular member 16 varies as a function of the geometry of the expansion surface 12*a* of the expansion device. Thus, for example, certain portions of the tubular member 16 that interface with the expansion surface 12*a* of the expansion device 12 may experience rates of strain that are different from other portions of the tubular member that interface with the expansion surface of the expansion device. In an exemplary embodiment, during the operation of the apparatus 10, the concentration of lubrication is increased in those areas having greater rates of strain as compared with those areas having lesser rates of strain in order to reduce the amount of energy and/or power required to radially expand and plastically deform the tubular member 16 using the expansion device 12. In an exemplary embodiment, as illustrated in FIG. 25, the relationship between the concentration of lubrication and the rate of strain is a linear relationship. In an alternative embodiment, as illustrated in FIG. 26, the relationship between the concentration of lubrication and the rate of strain is a non-linear relationship having a decreasing slope with increasing rate of strain. In an alternative embodiment, as illustrated in FIG. 27, the relationship between the concentration of lubrication and the rate of strain is a non-linear relationship having an decreasing slope with increasing rate of strain. In an alternative embodiment, as illustrated in FIG. 28, the relationship between the concentration of lubrication and the rate of strain includes one or more step functions. In an alternative embodiment, as illustrated in FIG. 29, the relationship between the concentration of lubrication and the rate of strain includes one or more of the characteristics of FIGS. 25-28.

In several exemplary embodiments, the concentration of lubrication within a specific portions of the expansion surface 12*a* of the expansion device 12 is increased by increasing one or more of the following: 1) the flow of the lubricant materials 22 and/or 32 into the annulus 24 surrounding the specific portion; 2) the volume of the films 40 and/or 50 applied to the specific portion; 3) the density of the recesses 60, 80, 100, 120, 130, 140, 160, 180, and/or 200 within the specific portion; and/or 4) the normalized oil volume within the specific portion.

More generally, in several exemplary embodiments, the concentration of lubrication within a specific portions of the expansion surface 12*a* of the expansion device 12 is controlled by adjusting one or more of the following: 1) the flow of the lubricant materials 22 and/or 32 into the annulus 24 surrounding the specific portion; 2) the volume of the films 40 and/or 50 applied to the specific portion; 3) the density of the recesses 60, 80, 100, 120, 130, 140, 160, 180, and/or 200 within the specific portion; and/or 4) the normalized oil volume within the specific portion.

In several exemplary embodiments, during at least a portion of the operation of the apparatus 10, at least portions of the annulus 24 between the expansion surface 12*a* of the expansion device 12 and the internal surface 16*a* of the tubular member 16 may be reduced in thickness to zero thereby permitting the at least a portion of the expansion surface of the expansion device to contact at least a portion of the interior surface of the tubular member.

In several exemplary embodiments, the lubricating films 40 and/or 50 include a physical vapor deposition Chromium Nitride coating commercially available from Phygen, Inc, in Minneapolis, Minn. In several exemplary embodiments, the lubricating films 40 and/or 50 are coupled to an expansion surface 12*a* fabricated from DC53 steel, new cold die steel, commercially available from Daido Steel Co. in Japan and/or International Steel Co., in Florence, Ky.

In several exemplary embodiments, the surface texture of at least a portion of one or more of the expansion surfaces 12*a* and/or one or more of the recesses 60, 80, 100, 120, 140, 160, 180, 200 and/or 240 is provided by polishing a surface roughness into the expansion surfaces and/or recesses using commercially available methods and apparatus available from REM Chemicals, in Brenham, Tex.

In several exemplary embodiments, the lubricant materials 22 and/or 32 include various environmentally friendly lubricant materials commercially available from Oleon, Inc. in Belgium and/or as lubricant materials # 2633-179 -1, 2, 3, 4, 5, and 6 from Houghton International, Valley Forge, Pa. In several exemplary embodiments, the lubricant materials 22 and/or 32 include Radiagreen eme salt.

Figure 30:
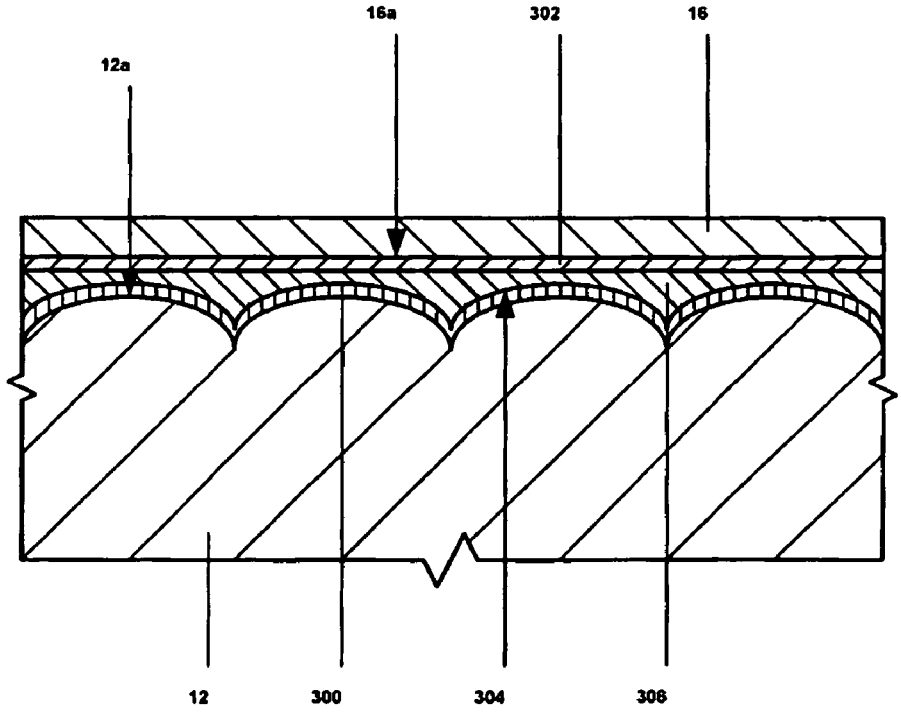
FIG. 30 is an exemplary embodiment of the apparatus of FIGS. 1*a* and 1*b*.

Referring to FIG. 30, in an exemplary embodiment, at least a portion of one or more of the expansion surfaces 12*a* of the expansion device 12 is textured and a lubricating film 300 is coupled to at least a portion of the textured expansion surface.

Furthermore, in an exemplary embodiment, at least a portion of the interior surface 16*a* of the tubular member 16 includes a lubricating film 302, and an annulus 304 defined between the expansion device 12 and the tubular member 16 includes a lubricant material 306. In an exemplary embodiment, the lubricating film 300 is harder and more resistant to abrasion than the lubricating film 302. In an exemplary embodiment, the use of a textured expansion surface 12*a*, the lubricating film 300, the lubricating film 302, and the lubricant film 306 during the operation of the apparatus 10 provided a friction coefficient less than about 0.02. In an exemplary embodiment, the textured expansion surface 12*a* is provided using one or more of the recesses 60, 80, 100, 120, 140, 160, 180, 200 and/or 240 described above and/or by texturing the expansion surface 12*a*. In an exemplary embodiment, the expansion surface 12*a* is fabricated from a DC53 tool steel, commercially available from Daido Steel in Japan, the texturing of the expansion surface 12*a* is provided by polishing the expansion surface using the commercially available products and services of REM Chemicals in Brenham, Tex., the lubricating film 300 includes a hard film Phygen 2, physical vapor deposition Chromium Nitride coating, commercially available from Phygen, Inc., in Minneapolis, Minn., the lubricating film 302 includes a Polytetrafluoroethylene (PTFE) based soft film coating, commercially available as a Brighton 9075 coating from Brighton Laboratories, in Howell, Mich., and the lubricant material 306 includes a commercially available lubricant from Houghton International, in Valley Forge, Pa.

In an exemplary embodiment, the surface texture of the expansion surface 12*a* and/or one or more of the recesses 60, 80, 100, 120, 140, 160, 180, 200 and/or 240 is characterized by one or more of the following parameters: $R_a$, $R_q$, $R_{sk}$, $R_{ku}$, $R_p$, $R_v$, $R_t$, $R_{pm}$, $R_{vm}$, $R_z$, $R_{pk}$, $R_k$, $R_{vk}$, $M_{r1}$, $M_{r2}$, $R_{pk}/R_k$, $R_{vk}/R_k$, $R_{pk}/R_{vk}$, X Slope $R_q$, Y Slope $R_q$, NVOL, and/or SAI. In an exemplary embodiment, the measurement of these parameters is provided using the commercially available services of Michigan Metrology LLC in Livonia, Mich.

$R_a$ refers to the arithmetic average of the absolute values of the surface height deviations measured from the best fitting plane, cylinder or sphere. Ra is described by:

$$R_a=\int\int_a|Z(x,y)|dxdy$$

where Z(x,y)=the vertical position of a position on the surface at coordinates x and y $R_q$ refers to the RMS (Standard Deviation) or "first moment" of the height distribution, as described by:

$$Rq=\sqrt{\int\int_a(Z(x,y))^2dxdy}$$

$R_{sk}$ refers to the skew or 'second moment" of the height distribution, as described by:

$$Rsk=\frac{1}{R_q^3}\int\int_a(Z(x,y))^3dxdy$$

$R_{ku}$ refers to the "kurtosis" or the "third moment" of the height distribution, described by:

$$R_{ky}=\frac{1}{R_q^4}\int\int_a(Z(x,y))^4dxdy$$

$R_p$, $R_v$, and $R_t$ are parameters valuated from the absolute highest and lowest points found on the surface. $R_p$ is the height of the highest point, $R_v$ is the depth of the lowest point and $R_t$ is found from Rp−Rv. The $R_{pm}$, $R_{vm}$, and $R_z$ parameters are evaluated from an average of the heights and depths of the extreme peaks and valleys. $R_{pm}$ is found by averaging the heights of the ten (10) highest peaks found over the complete 3D image. $R_{vm}$ is found by averaging the depths of the ten (10) lowest valleys found over the complete 3D image. $R_z$ is then found by ($R_{pm}-R_{vm}$).

The parameters Rpk, Rk, Rvk, Mr1, and Mr2 are all derived from the bearing ratio curve based on the DIN 4776 standard, the disclosure of which is incorporated herein by reference. The bearing area curve is a measure of the relative cross-sectional area a plane passing through the measured surface, from the highest peak to the lowest valley, would encounter. $R_{pk}$ is a measure of the peak height above the nominal/core roughness. $R_k$ is a measure of the nominal or "core" roughness ("peak to valley") of the surface. $R_{vk}$ is a measure of the valley depth below the nominal/core roughness. $M_{r1}$, the peak material ratio, indicates the percentage of material that comprise the peak structures associate with $R_{pk}$. $M_{r2}$ is a measure of the valley material ratio, with (100%−$Mr_2$) representing the percentage of material that comprise the valley structures associated with $R_{vk}$.

$R_{pk}/R_k$, $R_{vk}/R_k$, $R_{pk}/R_{vk}$: the ratios of the various bearing ratio parameters may be helpful in further understanding the nature of a particular surface texture. In some instances two surfaces with indistinguishable average roughness ($R_a$) may be easily distinguished by the ratio such as $R_{pk}/R_k$. For example, a surface with high peaks as opposed to a surface with deep valleys may have the same $R_a$ but with vastly different $R_{pk}/R_k$ values.

X Slope $R_q$, Y Slope $R_q$: The parameters X Slope $R_q$ and Y Slope $R_q$ are found by calculating the Standard Deviation (i.e. RMS or $R_q$) of the slopes of the surface along the X and Y directions respectively. The slope is found by taking the derivative of the surface profiles along each direction, using the lateral resolution of the measurement area as the point spacing. Analytically, X Slope $R_q$ and Y Slope $R_q$ are given by:

$$X\ \text{Slope}\ Rq=\left(\int\int_a\left(\frac{\partial Z(x,y)}{\partial x}-<\frac{\partial Z(x,y)}{\partial x}>\right)^2dxdy\right)^{1/2}$$

$$Y\ \text{Slope}\ Rq=\left(\int\int_a\left(\frac{\partial Z(x,y)}{\partial y}-<\frac{\partial Z(x,y)}{\partial y}>\right)^2dxdy\right)^{1/2}$$

Where the brackets, < >, represent the average value of all slopes in the relevant direction NVOL: The Normalized Volume (NVOL) of the surface is found by calculating the volume contained by the surface and a "plane" that is placed near the top of the surface. The placement of the reference plane is typically done on a statistical basis to assure that the very high peak locations are not used as the reference point for the plan. Once the volume is calculated (e.g. in units of $cm^3$), the result is "normalized" to the cross sectional area of the plane (i.e. units of $m^2$). Other units of NVOL are BCM, which is an acronym for "Billions of Cubic Microns per Inch Squared".

The Surface Area Index (SAI) evaluates the surface area at the lateral resolution of the measured surface as compared to that of a perfectly flat/smooth surface. The calculation involves fitting triangular patches between the measured points and adding up the total area of all patches. A ratio is then formed of the total surface area measured and the nominal flat area of measurement. This analysis is a precursor to a complete fractal analysis of the surface. Since SAI is a ratio, it is a unit-less quantity.

In an exemplary embodiment, one or more of the parameters $R_a$, $R_q$, $R_{sk}$, $R_{ku}$, $R_p$, $R_v$, $R_t$, $R_{pm}$, $R_{vm}$, $R_z$, $R_{pk}$, $R_k$, $R_{vk}$, $M_{r1}$, $M_{r2}$, $R_{pk}/R_k$, $R_{vk}/R_k$, $R_{pk}/R_{vk}$, X Slope $R_q$, Y Slope $R_q$, NVOL, and/or SAI described above are defined as described at the following website: http://www.michmet.com, the disclosure of which is incorporated herein by reference.

Figures 31A, 31B, 31C, 31D:
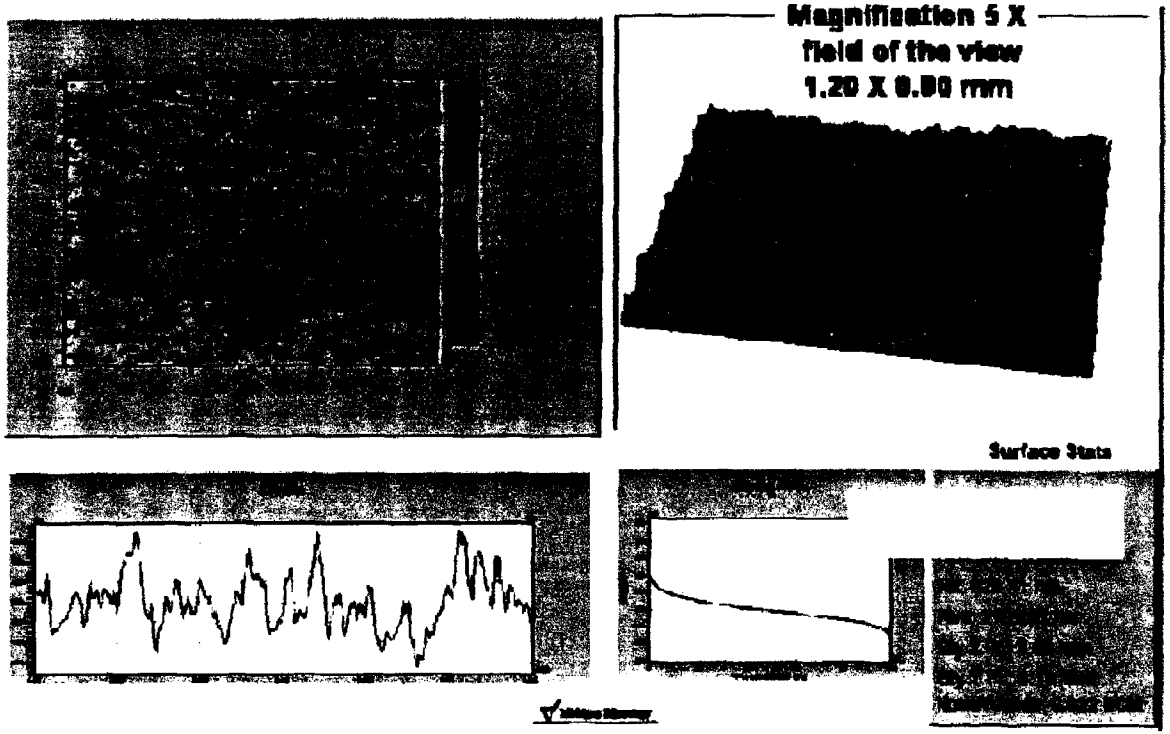
FIGS. 31*a*, 31*b*, 31*c*, and 31*d* are illustrations of an exemplary embodiment of the apparatus of FIGS. 1*a* and 1*b*.

In an exemplary implementation, an apparatus 10 having an expansion device 12 including an expansion surface 12*a* fabricated from conventional D2 steel was operated to expand a plurality of tubular members 16 fabricated from low carbon steel using a water base mud media as a lubricating material. FIG. 31*a* is top view of a portion of the expansion surface 12*a* of the expansion device 12 of the apparatus after repeated radial expansions and plastic deformations of the tubular members 16 using the apparatus 10. FIG. 31*b* is a magnified perspective view of the portion of the expansion surface 12*a* of the expansion device 12 of the apparatus after repeated radial expansions and plastic deformations of the tubular members 16 using the apparatus 10. FIG. 31*c* is a graphical illustration of the surface profile of a sliced portion of the portion of the expansion surface 12*a* of the expansion device 12 of the apparatus after repeated radial expansions and plastic deformations of the tubular members 16 using the apparatus 10. FIG. 31*d* is a graphical and tabular illustration of the bearing ratio, $R_a$, $R_z$, $R_{pk}$, $R_k$, $R_{vk}$, Sty X Pc (X Slope $R_q$), Sty Y Pc (Y Slope $R_q$), and NVOL for the portion of the expansion surface 12*a* of the expansion device 12 of the apparatus after repeated radial expansions and plastic deformations of the tubular members 16 using the apparatus 10. As illustrated in FIG. 31*d*, the exemplary implementation had the following characteristics:

| Parameter | Valu |
|---|---|
| $R_a$ | 277.930 nm |
| $R_z$ | 3.13 nm |
| $R_{pk}$ | 377.167 nm |
| $R_k$ | 829.31 nm |
| $R_{vk}$ | 216.287 nm |
| Slope $R_q$ | 3.88/mm |
| Y Slope $R_q$ | 6.13/mm |
| NVOL | 0.822 BCM |

In the exemplary implementation of the embodiment of FIGS. 31*a*, 31*b*, 31*c*, and 31*d*, the forces required to overcome friction during the operation of the apparatus 10 were about 45% of all the expansion forces required to radially expand and plastically deform the tubular member 16 and the coefficient of friction for the interface between the expansion surfaces 12*a* of the expansion device 12 and the interior surface 16*a* of the tubular member was about 0.125.

In an exemplary implementation, an apparatus 10 having an expansion device 12 including an expansion surface 12*a* fabricated from DC53 tool steel, available from Daido Steel in Japan, was operated to expand a plurality of tubular members 16 fabricated from low carbon steel. The expansion surface 12*a* was surface polished using the services of REM Chemicals in Brenham, Tex. and a lubricating film including a Chromium Nitride coating, available from Phygen, Inc., in Minneapolis, Minn., was coupled to the expansion surface. FIG. 32*a* is top view of a portion of the expansion surface 12*a* of the expansion device 12 of the apparatus after repeated radial expansions and plastic deformations of the tubular members 16 using the apparatus 10. FIG. 32*b* is a magnified perspective view of the portion of the expansion surface 12*a* of the expansion device 12 of the apparatus after repeated radial expansions and plastic deformations of the tubular members 16 using the apparatus 10. FIG. 32*c* is a graphical illustration of the surface profile of a sliced portion of the portion of the expansion surface 12*a* of the expansion device 12 of the apparatus after repeated radial expansions and plastic deformations of the tubular members 16 using the apparatus 10. FIG. 32*d* is a graphical and tabular illustration of the bearing ratio, $R_a$, $R_z$, $R_{pk}$, $R_k$, $R_{vk}$, Sty X Pc (X Slop $R_q$), Sty Y Pc (Y Slope $R_q$), and NVOL for the portion of the expansion surface 12*a* of the expansion device 12 of the apparatus after repeated radial expansions and plastic deformations of the tubular members 16 using the apparatus 10. As illustrated in FIG. 32*d*, the exemplary implementation had the following characteristics:

| Parameter | Value |
|---|---|
| $R_a$ | 60.205 nm |
| $R_z$ | 1.99 nm |
| $R_{pk}$ | 25.009 nm |
| $R_k$ | 152.12 nm |
| $R_{vk}$ | 92.963 nm |
| Slope $R_q$ | 2.21/mm |
| Y Slope $R_q$ | 3.53/mm |
| NVOL | 0.047 BCM |

In the exemplary implementation of the embodiment of FIGS. 32*a*, 32*b*, 32*c*, and 32*d*, the forces required to overcome friction during the operation of the apparatus 10 were between about 30% to 8% of all the expansion forces required to radially expand and plastically deform the tubular member 16 and the coefficient of friction for the interface between the expansion surfaces 12*a* of the expansion device 12 and the interior surface 16*a* of the tubular member was about 0.06. Furthermore, in the exemplary embodiment of FIGS. 32*a*, 32*b*, 32*c*, and 32*d*, the bearing ratio of the expansion surface 12*a* of the expansion device 12 was greater than 75% on 60% of the $R_z$ surface roughness.

A comparison of the exemplary implementation illustrated in FIGS. 31*a*, 31*b*, 31*c*, and 31*d* and the exemplary implementation illustrated in FIGS. 32*a*, 32*b*, 32*c*, and 32*d* indicated that an example of a preferred surface texture for an expansion surface 12*a* of the expansion device 12 during the radial expansion and plastic deformation of the tubular member 16 was a surface texture having a plateau-like surface with relatively deep recesses as provided in the exemplary implementation of FIGS. 32*a*, 32*b*, 32*c*, and 32*d*. This was an unexpected result.

Furthermore, a comparison of the exemplary implementation illustrated in FIGS. 31*a*, 31*b*, 31*c*, and 31*d* and the exemplary implementation illustrated in FIGS. 32*a*, 32*b*, 32*c*, and 32*d* also indicated that the expansion surface of the exemplary implementation illustrated in FIGS. 32*a*, 32*b*, 32*c*, and 32*d* provided not only a smoother surface, as measured by $R_a$ and/or $R_z$, but also provided much higher load capacity, as measured by the bearing ratio. Furthermore, the bearing ratio for the exemplary implementation illustrated in FIGS. 32*a*, 32*b*, 32*c*, and 32*d* had much less variation in value that the bearing ratio for the exemplary implementation illustrated in FIGS. 31*a*, 31*b*, 31*c*, and 31*d*. Thus, in a preferred embodiment, the bearing ratio varies less than about 15% across the expansion surface 12*a*. In addition, the exemplary implementation illustrated in FIGS. 32*a*, 32*b*, 32*c*, and 32*d* provided a bearing ratio about double that of the exemplary implementation illustrated in FIGS. 31*a*, 31*b*, 31*c*, and 31*d*. For example, at the level of 60% $R_z$, the percentage of the material supporting a load on the exemplary implementation illustrated in FIGS. 32*a*, 32*b*, 32*c*, and 32*d* was about 80% in comparison to about 37% for the exemplary implementation illustrated in FIGS. 31*a*, 31*b*, 31*c*, and 31*d*.

In an exemplary embodiment, the preferred surface texture of the exemplary implementation of FIGS. 32*a*, 32*b*, 32*c*, and 32*d*, a plateau-like surface with relatively deep recesses, is provided by laser dimpling the expansion surface 12*a*.

Figure 33:
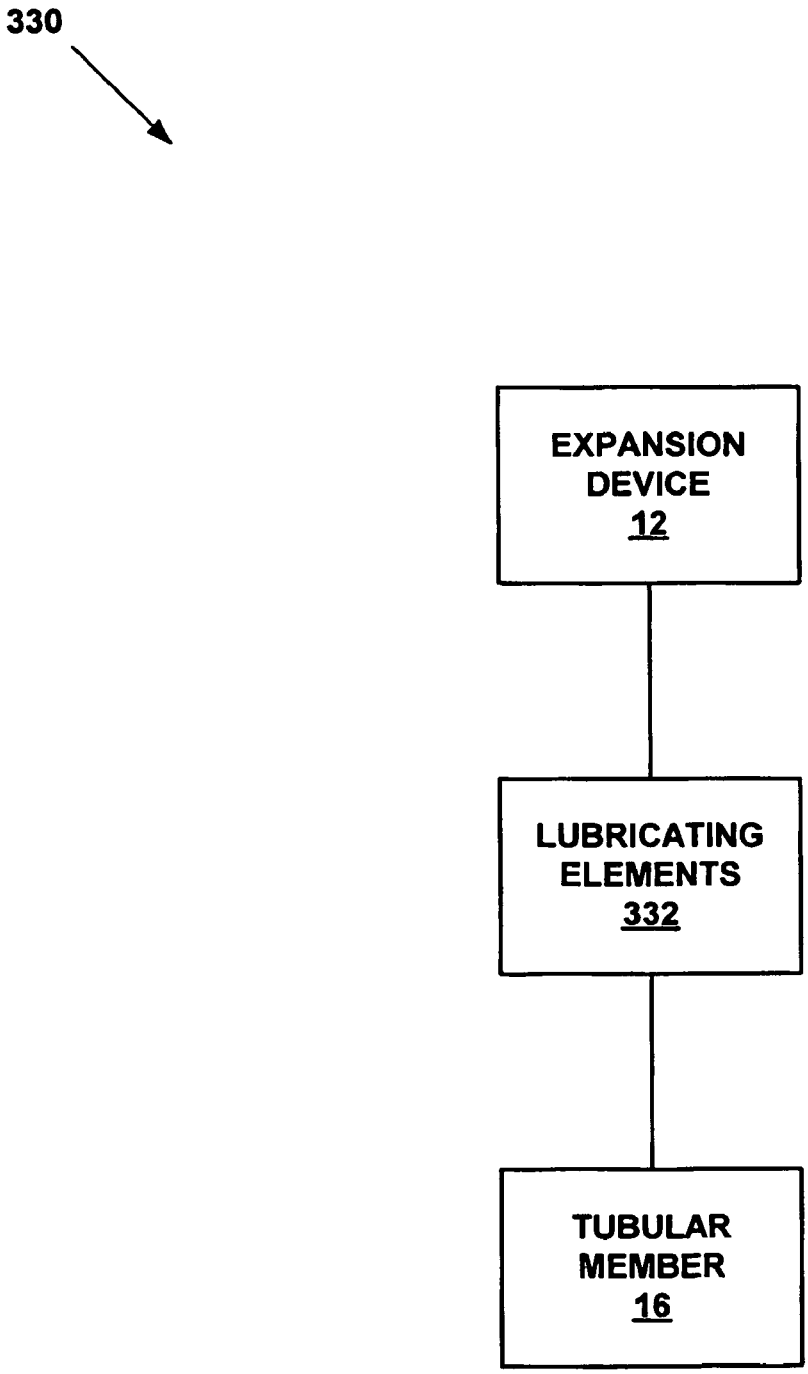
FIG. 33 is a schematic illustration of a tribological system.

In an exemplary embodiment, as illustrated in FIG. 33, the apparatus 10 provides a tribological system 330 including the expansion device 12, the tubular member 16, and one or more lubricating elements 332 such as, for example, those elements described above for reducing friction between the expansion surfaces 12*a* of the expansion device and the tubular member during the operation of the apparatus 10. In an exemplary embodiment, the system 330 is designed and operated to minimize the friction between the expansion device 12 and the tubular member 16.

An expansion cone for radially expanding multiple tubular members has been described that includes a body having an annular outer peripheral surface, and at least a portion of the surface being textured with friction reducing reliefs recessed into the surface. In an exemplary embodiment, the surface includes a knurled surface. In an exemplary embodiment, the surface includes a laser dimpled surface. In an exemplary embodiment, the surface includes a pitted and sprayed surface. In an exemplary embodiment, the body includes the pitted surface formed of a first material, the pitted surface being sprayed with a second friction reducing material and the sprayed surface being partially removed sufficient to expose some of the first and second materials. In an exemplary embodiment, the surface includes an etched surface.

A method for radially expanding a tubular member has been described that includes providing a tubular member having an inside diameter, providing an expansion cone having an annular outer peripheral surface including a diameter greater than the inside diameter of the tubular member, texturing the outer peripheral surface with friction reducing reliefs recessed into the surface, and moving the expansion cone axially through the tubular member for radially expanding and plastically deforming the tubular member. In an exemplary embodiment, the surface includes a knurled surface. In an exemplary embodiment, the surface includes a laser dimpled surface. In an exemplary embodiment, the surface includes a pitted and sprayed surface. In an exemplary embodiment, the method further includes pitting the outer peripheral surface, spraying the surface, and grinding the surface to expose both an original portion of the surface and a sprayed portion of the surface. In an exemplary embodiment, the surface includes an etched surface.

A reduced friction radial expansion apparatus has been described that includes a plurality of tubular members having an axial passage formed therethrough including an inside diameter, an expansion cone having an annular outer peripheral surface including an outside diameter greater than the inside diameter of the axial passage, and at least a portion of the outer peripheral surface being textured with friction reducing reliefs recessed into the surface. In an exemplary embodiment, the surface includes a knurled surface. In an exemplary embodiment, the surface includes a laser dimpled surface. In an exemplary embodiment, the surface includes a pitted and sprayed surface. In an exemplary embodiment, the cone includes a pitted surface formed of a first material, the pitted surface being sprayed with a second friction reducing material and the sprayed surface being partially removed sufficient to expose some of the first and second materials. In an exemplary embodiment, the surface includes an etched surface. In an exemplary embodiment, a low friction material includes deposited in the reliefs. In an exemplary embodiment, the outer peripheral surface includes a flush surface including a combination of portions of material of the expansion cone and portions of a low friction material deposited in the reliefs.

An apparatus for radially expanding and plastically deforming a tubular member has been described that includes a support member, an expansion device coupled to an end of the support member comprising one or more expansion surfaces for engaging the tubular member during the radial expansion and plastic deformation of the tubular member, and a lubrication system for lubricating an interface between one or more of the expansion surfaces of the expansion device and one or more interior surfaces of the tubular member. In an exemplary embodiment, the lubrication system includes a supply of a lubricant, and an injector for injecting the lubricant into the interface. In an exemplary embodiment, the supply of lubricant is provided within the expansion device. In an exemplary embodiment, one or more of the expansion surfaces define one or more recesses, and one or more of the recesses are coupled to the injector. In an exemplary embodiment, the lubrication system includes a lubricating film coupled to one or more of the expansion surfaces. In an exemplary embodiment, one or more of the expansion surfaces define one or more recesses, and at least a portion of the lubricating film is deposited within one or more of the recesses. In an exemplary embodiment, one or more of the expansion surfaces of the expansion device define one or more recesses. In an exemplary embodiment, at least some of the recesses are identical to one another. In an exemplary embodiment, at least some of the recesses are equally spaced from one another. In an exemplary embodiment, a depth dimension of the recesses are non-uniform. In an exemplary embodiment, at least some of the recesses intersect. In an exemplary embodiment, the location of at least some of the recesses is randomly distributed. In an exemplary embodiment, the geometry of at least some of the recesses is randomly distributed. In an exemplary embodiment, a surface texture of at least some of the recesses is randomly distributed. In an exemplary embodiment, the geometry of at least some of the recesses is linear. In an exemplary embodiment, the geometry of at least some of the recesses is non-linear. In an exemplary embodiment, the interface includes a leading edge portion and a trailing edge portion, and the lubrication system provides a higher lubrication concentration in at least one of the leading and trailing edge portions. In an exemplary embodiment, one or more of the expansion surfaces of the expansion device define one or more recesses, and the apparatus further includes one or more lubricating ball bearings supported within at least one of the recesses. In an exemplary embodiment, a lubrication concentration provided by the lubrication system is varied as a function of a rate of strain of the tubular member during an operation of the apparatus. In an exemplary embodiment, the function includes a linear function. In an exemplary embodiment, the function includes a non-linear function. In an exemplary embodiment, the function includes a step function.

A method for radially expanding and plastically deforming a tubular member has been described that includes radially expanding and plastically deforming the tubular member using an expansion device comprising one or more expansion surfaces, and lubricating an interface between one or more of the expansion surfaces of the expansion device and one or more interior surfaces of the tubular member. In an exemplary embodiment, the method further includes injecting a supply of lubricant into the interface. In an exemplary embodiment, the supply of lubricant is provided within the expansion device. In an exemplary embodiment, one or more of the expansion surfaces define one or more recesses, and the method further comprises injecting the supply of lubricant into one or more of the recesses. In an exemplary embodiment, the method further includes coupling a lubricating film to one or more of the expansion surfaces. In an exemplary embodiment, one or more of the expansion surfaces define one or more recesses, and at least a portion of the lubricating film is coupled to one or more of the recesses. In an exemplary embodiment, one or more of the expansion surfaces of the expansion device define one or more recesses. In an exemplary embodiment, at least some of the recesses are identical to one another. In an exemplary embodiment, at least some of the recesses are equally spaced from one another. In an exemplary embodiment, a depth dimension of the recesses are non-uniform. In an exemplary embodiment, at least some of the recesses intersect. In an exemplary embodiment, the location of at least some of the recesses is randomly distributed. In an exemplary embodiment, the geometry of at least some of the recesses is randomly distributed. In an exemplary embodiment, a surface texture of at least some of the recesses is randomly distributed. In an exemplary embodiment, the geometry of at least some of the recesses is linear. In an exemplary embodiment, the geometry of at least some of the recesses is non-linear. In an exemplary embodiment, the interface includes a leading edge portion and a trailing edge portion, and the method further includes providing a higher lubrication concentration in at least one of the leading and trailing edge portions. In an exemplary embodiment, one or more of the expansion surfaces of the expansion device define one or more recesses, and the method further comprises forming one or more lubricating ball bearings within at least one of the recesses. In an exemplary embodiment, the method further includes varying a lubrication concentration as a function of a rate of strain of the tubular member during the radial expansion and plastic deformation of the tubular member. In an exemplary embodiment, the function includes a linear function, a non-linear function, and/or a step function.

A system for lubricating an interface between an expansion device and a tubular member during a radial expansion of the tubular member by the expansion device has been described that includes means for supplying a quantity of a lubricant material, and means for injecting at least a portion of the lubricant material into the interface. In an exemplary embodiment, the system further includes means for varying the concentration of the lubricant material within the interface.

A method of operating a system for lubricating an interface between an expansion device and a tubular member during a radial expansion of the tubular member by the expansion device has been described that includes determining a rate of strain of the tubular member during an operation of the expansion device, and varying a concentration of a lubricant material within the interface during the operation of the expansion device as a function of the determined rate of strain.

A method of operating a system for lubricating an interface between an expansion device and a tubular member during a radial expansion of the tubular member by the expansion device has been described that includes determining one or more characteristics of the interface during an operation of the expansion device, and varying a concentration of a lubricant material within the interface during the operation of the expansion device as a function of one or more of the determined characteristics.

A system for lubricating an interface between an expansion device and a tubular member during a radial expansion of the tubular member by the expansion device has been described that includes means for determining a rate of strain of the tubular member during an operation of the expansion device, and means for varying a concentration of a lubricant material within the interface during the operation of the expansion device as a function of the determined rate of strain.

A system for lubricating an interface between an expansion device and a tubular member during a radial expansion of the tubular member by the expansion device has been described that includes means for determining one or more characteristics of the interface during an operation of the expansion device, and means for varying a concentration of a lubricant material within the interface during the operation of the expansion device as a function of one or more of the determined characteristics.

A method of operating a system for lubricating an interface between an expansion device and a tubular member during a radial expansion of the tubular member by the expansion device has been described that includes determining one or more characteristics of the operation of the expansion device, and varying a concentration of a lubricant material within the interface during the operation of the expansion device as a function of one or more of the determined characteristics.

A system for lubricating an interface between an expansion device and a tubular member during a radial expansion of the tubular member by the expansion device has been described that includes means for determining one or more characteristics of the operation of the expansion device, and means for varying a concentration of a lubricant material within the interface during the operation of the expansion device as a function of one or more of the determined characteristics.

A tribological system for lubricating an interface between an expansion device and a tubular member during a radial expansion and plastic deformation of the tubular member, has been described that includes an expansion surface coupled to the expansion device defining a surface texture, a first lubricating film coupled to the expansion surface, a second lubricating film coupled to an interior surface of the tubular member, and a lubricating material disposed within an annulus defined between the expansion surface of the expansion device and the interior surface of the tubular member. In an exemplary embodiment, a resistance to abrasion of the first lubricating film is greater than a resistance to abrasion of the second lubricating film. In an exemplary embodiment, the $R_a$ for the expansion surface is less than or equal to 60.205 nm. In an exemplary embodiment, the $R_z$ for the expansion surface is less than or equal to 1.99 nm. In an exemplary embodiment, the $R_a$ for the expansion surface is about 60.205 nm. In an exemplary embodiment, the $R_z$ for the expansion surface is about 1.99 nm. In an exemplary embodiment, the $R_a$ for the expansion surface is less than or equal to 277.930 nm. In an exemplary embodiment, the $R_z$ for the expansion surface is less than or equal to 3.13 nm. In an exemplary embodiment, the $R_a$ for the expansion surface is less than or equal to 277.930 nm and greater than or equal to 60.205 nm. In an exemplary embodiment, the $R_z$ for the expansion surface is less than or equal to 3.13 nm and greater than or equal to 1.99 nm. In an exemplary embodiment, the expansion surface includes a plateau-like surface that defines one or more relatively deep recesses. In an exemplary embodiment, the first lubricating film includes chromium nitride. In an exemplary embodiment, the second lubricating film includes PTFE. In an exemplary embodiment, the expansion surface includes DC53 tool steel. In an exemplary embodiment, the coefficient of friction for the interface is less than or equal to 0.125. In an exemplary embodiment, the coefficient of friction for the interface is less than 0.125. In an exemplary embodiment, the coefficient of friction for the interface is less than or equal to 0.06. In an exemplary embodiment, the coefficient of friction for the interface is less than 0.06. In an exemplary embodiment, the expansion surface includes a polished surface. In an exemplary embodiment, the forces required to overcome friction during the radial expansion and plastic deformation of the tubular member are less than or equal to 45% of the total forces required to radially expand and plastically deform the tubular member. In an exemplary embodiment, the forces required to overcome friction during the radial expansion and plastic deformation of the tubular member are less than 45% of the total forces required to radially expand and plastically deform the tubular member. In an exemplary embodiment, the forces required to overcome friction during the radial expansion and plastic deformation of the tubular member are less than or equal to 8% of the total forces required to radially expand and plastically deform the tubular member. In an exemplary embodiment, the forces required to overcome friction during the radial expansion and plastic deformation of the tubular member are less than 8% of the total forces required to radially expand and plastically deform the tubular member. In an exemplary embodiment, the bearing ratio of the expansion surface varies less than about 15%. In an exemplary embodiment, the bearing ratio of the expansion surface of the expansion device is greater than 75% on 60% of the $R_z$ surface roughness.

A method of lubricating an interface between an expansion surface of an expansion device and a tubular member during a radial expansion and plastic deformation of the tubular member has been described that includes texturing the expansion surface, coupling a first lubricating film coupled to the expansion surface, coupling a second lubricating film to an interior surface of the tubular member, and disposing a lubricating material within an annulus defined between the expansion surface of the expansion device and the interior surface of the tubular member. In an exemplary embodiment, a resistance to abrasion of the first lubricating film is greater than a resistance to abrasion of the second lubricating film. In an exemplary embodiment, the $R_a$ for the expansion surface is less than or equal to 60.205 nm. In an exemplary embodiment, the $R_z$ for the expansion surface is less than or equal to 1.99 nm. In an exemplary embodiment, the $R_a$ for the expansion surface is about 60.205 nm. In an exemplary embodiment, the $R_z$ for the expansion surface is about 1.99 nm. In an exemplary embodiment, the $R_a$ for the expansion surface is less than or equal to 277.930 nm. In an exemplary embodiment, the $R_z$ for the expansion surface is less than or equal to 3.13 nm. In an exemplary embodiment, the $R_a$ for the expansion surface is less than or equal to 277.930 nm and greater than or equal to 60.205 nm. In an exemplary embodiment, the $R_z$ for the expansion surface is less than or equal to 3.13 nm and greater than or equal to 1.99 nm. In an exemplary embodiment, the expansion surface includes a plateau-like surface that defines one or more relatively deep recesses. In an exemplary embodiment, the first lubricating film includes chromium nitride. In an exemplary embodiment, the second lubricating film includes PTFE. In an exemplary embodiment, the expansion surface includes DC53 tool steel. In an exemplary embodiment, the coefficient of friction for the interface is less than or equal to 0.125. In an exemplary embodiment, the coefficient of friction for the interface is less than 0.125. In an exemplary embodiment, the coefficient of friction for the interface is less than or equal to 0.06. In an exemplary embodiment, the coefficient of friction for the interface is less than 0.06. In an exemplary embodiment, the expansion surface includes a polished surface. In an exemplary embodiment, the forces required to overcome friction during the radial expansion and plastic deformation of the tubular member are less than or equal to 45% of the total forces required to radially expand and plastically deform the tubular member. In an exemplary embodiment, the forces required to overcome friction during the radial expansion and plastic deformation of the tubular member are less than 45% of the total forces required to radially expand and plastically deform the tubular member. In an exemplary embodiment, the forces required to overcome friction during the radial expansion and plastic deformation of the tubular member are less than or equal to 8% of the total forces required to radially expand and plastically deform the tubular member. In an exemplary embodiment, the forces required to overcome friction during the radial expansion and plastic deformation of the tubular member are less than 8% of the total forces required to radially expand and plastically deform the tubular member. In an exemplary embodiment, the bearing ratio of the expansion surface varies less than about 15%. In an exemplary embodiment, the bearing ratio of the expansion surface of the expansion device is greater than 75% on 60% of the $R_z$ surface roughness.

A system for radially expanding and plastically deforming a tubular member has been described in which the amount of energy required to overcome frictional forces during the radial expansion and plastic deformation of the tubular member is less than or equal to 45% of the total amount of energy required to radially expand and plastically deform the tubular member.

A system for radially expanding and plastically deforming a tubular member has been described that includes an expansion device, wherein the coefficient of friction between the expansion device and the tubular member during the radial expansion and plastic deformation of the tubular member is less than or equal to 0.125.

A system for radially expanding and plastically deforming a tubular member has been described in which the amount of energy required to overcome frictional forces during the radial expansion and plastic deformation of the tubular member is less than or equal to 8% of the total amount of energy required to radially expand and plastically deform the tubular member.

A system for radially expanding and plastically deforming a tubular member has been described that includes an expansion device, wherein the coefficient of friction between the expansion device and the tubular member during the radial expansion and plastic deformation of the tubular member is less than or equal to 0.06.

A tribological system for lubricating an interface between an expansion device and a tubular member during a radial expansion and plastic deformation of the tubular member has been described that includes an expansion surface coupled to the expansion device defining a surface texture, a first lubricating film coupled to the expansion surface, and a second lubricating film coupled to an interior surface of the tubular member, wherein a resistance to abrasion of the first lubricating film is greater than a resistance to abrasion of the second lubricating film.

A tribological system for lubricating an interface between an expansion device and a tubular member during a radial expansion and plastic deformation of the tubular member has been described that includes an expansion surface coupled to the expansion device defining a surface texture, wherein the $R_a$ for the expansion surface is less than or equal to 60.205 nm.

A tribological system for lubricating an interface between an expansion device and a tubular member during a radial expansion and plastic deformation of the tubular member has been described that includes an expansion surface coupled to the expansion device defining a surface texture, wherein the $R_z$ for the expansion surface is less than or equal to 1.99 nm.

A tribological system for lubricating an interface between an expansion device and a tubular member during a radial expansion and plastic deformation of the tubular member has been described that includes an expansion surface coupled to the expansion device defining a surface texture, wherein the $R_a$ for the expansion surface is about 60.205 nm.

A tribological system for lubricating an interface between an expansion device and a tubular member during a radial expansion and plastic deformation of the tubular member has been described that includes an expansion surface coupled to the expansion device defining a surface texture, wherein the $R_z$ for the expansion surface is about 1.99 nm.

A tribological system for lubricating an interface between an expansion device and a tubular member during a radial expansion and plastic deformation of the tubular member has been described that includes an expansion surface coupled to the expansion device defining a surface texture, wherein the $R_a$ for the expansion surface is less than or equal to 277.930 nm.

A tribological system for lubricating an interface between an expansion device and a tubular member during a radial expansion and plastic deformation of the tubular member has been described that includes an expansion surface coupled to the expansion device defining a surface texture, wherein the $R_z$ for the expansion surface is less than or equal to 3.13 nm.

A tribological system for lubricating an interface between an expansion device and a tubular member during a radial expansion and plastic deformation of the tubular member has been described that includes an expansion surface coupled to the expansion device defining a surface texture, wherein the $R_a$ for the expansion surface is less than or equal to 277.930 nm and greater than or equal to 60.205 nm.

A tribological system for lubricating an interface between an expansion device and a tubular member during a radial expansion and plastic deformation of the tubular member has been described that includes an expansion surface coupled to the expansion device defining a surface texture, wherein the $R_z$ for the expansion surface is less than or equal to 3.13 nm and greater than or equal to 1.99 nm.

A tribological system for lubricating an interface between an expansion device and a tubular member during a radial expansion and plastic deformation of the tubular member has been described that includes an expansion surface coupled to the expansion device defining a surface texture, wherein the expansion surface comprises a plateau-like surface that defines one or more relatively deep recesses.

A tribological system for lubricating an interface between an expansion device and a tubular member during a radial expansion and plastic deformation of the tubular member has been described that includes an expansion surface coupled to the expansion device defining a surface texture, and a lubricating film coupled to the expansion surface, wherein the first lubricating film includes chromium nitride.

A tribological system for lubricating an interface between an expansion device and a tubular member during a radial expansion and plastic deformation of the tubular member has been described that includes an expansion surface coupled to the expansion device defining a surface texture, and a lubricating film coupled to an interior surface of the tubular member, wherein the lubricating film includes PTFE.

A tribological system for lubricating an interface between an expansion device and a tubular member during a radial expansion and plastic deformation of the tubular member has been described that includes an expansion surface coupled to the expansion device defining a surface texture, wherein the expansion surface comprises DC53 tool steel.

A tribological system for lubricating an interface between an expansion device and a tubular member during a radial expansion and plastic deformation of the tubular member has been described that includes an expansion surface coupled to the expansion, wherein the coefficient of friction for the interface is less than or equal to 0.125.

A tribological system for lubricating an interface between an expansion device and a tubular member during a radial expansion and plastic deformation of the tubular member has been described that includes an expansion surface coupled to the expansion, wherein the coefficient of friction for the interface is less than 0.125.

A tribological system for lubricating an interface between an expansion device and a tubular member during a radial expansion and plastic deformation of the tubular member has been described that includes an expansion surface coupled to the expansion, wherein the coefficient of friction for the interface is less than or equal to 0.06.

A tribological system for lubricating an interface between an expansion device and a tubular member during a radial expansion and plastic deformation of the tubular member has been described that includes an expansion surface coupled to the expansion, wherein the coefficient of friction for the interface is less than 0.06.

A tribological system for lubricating an interface between an expansion device and a tubular member during a radial expansion and plastic deformation of the tubular member has been described that includes an expansion surface coupled to the expansion, wherein the expansion surface comprises a polished surface.

A tribological system for lubricating an interface between an expansion device and a tubular member during a radial expansion and plastic deformation of the tubular member has been described that includes an expansion surface coupled to the expansion, wherein the forces required to overcome friction during the radial expansion and plastic deformation of the tubular member are less than or equal to 45% of the total forces required to radially expand and plastically deform the tubular member.

A tribological system for lubricating an interface between an expansion device and a tubular member during a radial expansion and plastic deformation of the tubular member has been described that includes an expansion surface coupled to the expansion, wherein the forces required to overcome friction during the radial expansion and plastic deformation of the tubular member are less than 45% of the total forces required to radially expand and plastically deform the tubular member.

A tribological system for lubricating an interface between an expansion device and a tubular member during a radial expansion and plastic deformation of the tubular member has been described that includes an expansion surface coupled to the expansion, wherein the forces required to overcome friction during the radial expansion and plastic deformation of the tubular member are less than or equal to 8% of the total forces required to radially expand and plastically deform the tubular member.

A tribological system for lubricating an interface between an expansion device and a tubular member during a radial expansion and plastic deformation of the tubular member has been described that includes an expansion surface coupled to the expansion, wherein the forces required to overcome friction during the radial expansion and plastic deformation of the tubular member are less than 8% of the total forces required to radially expand and plastically deform the tubular member.

A tribological system for lubricating an interface between an expansion device and a tubular member during a radial expansion and plastic deformation of the tubular member has been described that includes an expansion surface coupled to the expansion, wherein the bearing ratio of the expansion surface varies less than about 15%.

A tribological system for lubricating an interface between an expansion device and a tubular member during a radial expansion and plastic deformation of the tubular member has been described that includes an expansion surface coupled to the expansion, wherein the bearing ratio of the expansion surface of the expansion device is greater than 75% on 60% of the $R_z$ surface roughness.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

The invention claimed is:

1. An expansion cone for radially expanding multiple tubular members, comprising:

a body having an annular outer peripheral surface, at least a portion of the surface being textured with friction reducing reliefs recessed into the surface; and one or more lubricating ball bearings supported within at least one of the reliefs.

2. The expansion cone as defined in claim 1, wherein the surface is a knurled surface.

3. The expansion cone as defined in claim 1, wherein the surface is a laser dimpled surface.

4. The expansion cone as defined in claim 1, wherein the surface is a pitted and sprayed surface.

5. The expansion cone as defined in claim 4, wherein the body comprises the pitted surface formed of a first material, the pitted surface being sprayed with a second friction reducing material and the sprayed surface being partially removed sufficient to expose some of the first and second materials.

6. The expansion cone as defined in claim 1, wherein the surface is an etched surface.

7. A method for radially expanding a tubular member, comprising:

providing a tubular member having an inside diameter;

providing an expansion cone having an annular outer peripheral surface comprising a diameter greater than the inside diameter of the tubular member;

texturing the outer peripheral surface with friction reducing reliefs recessed into the surface;

moving the expansion cone axially through the tubular member for radially expanding and plastically deforming the tubular member; and lubricating an interface between one or more of the expansion surfaces of the expansion device and one or more interior surfaces of the tubular member, wherein a lubrication concentration provided in the lubricating step is varied as a function of a rate of strain of the tubular member during the moving step.

8. The method as defined in claim 7, wherein the surface is a knurled surface.

9. The method as defined in claim 7, wherein the surface is a laser dimpled surface.

10. The method as defined in claim 7, wherein the surface is a pitted and sprayed surface.

11. The method as defined in claim 7, further comprising:

pitting the outer peripheral surface;

spraying the surface; and grinding the surface to expose both an original portion of the surface and a sprayed portion of the surface.

12. The method as defined in claim 7, wherein the surface is an etched surface.

13. The apparatus of claim 7, wherein the function comprises a linear function.

14. The apparatus of claim 7, wherein the function comprises a non-linear function.

15. The apparatus of claim 7, wherein the function comprises a step function.

16. A reduced friction radial expansion apparatus, comprising:

a plurality of tubular members having an axial passage formed therethrough and comprising an inside diameter;

an expansion cone having an annular outer peripheral surface comprising an outside diameter greater than the inside diameter of the axial passage, at least a portion of the outer peripheral surface being textured with friction reducing reliefs recessed into the surface; and one or more lubricating ball bearings supported within at least one of the reliefs.

17. The apparatus as defined in claim 16, wherein the surface is a knurled surface.

18. The apparatus as defined in claim 16, wherein the surface is a laser dimpled surface.

19. The apparatus as defined in claim 16, wherein the surface is a pitted and sprayed surface.

20. The apparatus as defined in claim 16, wherein the cone comprises a pitted surface formed of a first material, the pitted surface being sprayed with a second friction reducing material and the sprayed surface being partially removed sufficient to expose some of the first and second materials.

21. The apparatus as defined in claim 16, wherein the surface is an etched surface.

22. The apparatus as defined in claim 16, wherein a low friction material is deposited in the reliefs.

23. The apparatus as defined in claim 16, wherein the outer peripheral surface comprises a flush surface comprising a combination of portions of material of the expansion cone and portions of a low friction material deposited in the reliefs.

24. An apparatus for radially expanding and plastically deforming a tubular member, comprising:

a support member;

an expansion device coupled to an end of the support member and comprising one or more expansion surfaces for engaging the tubular member during the radial expansion and plastic deformation of the tubular member, wherein one or more of the expansion surfaces of the expansion device define one or more recesses;

one or more lubricating ball bearings supported within at least one of the recesses; and a lubrication system for lubricating an interface between one or more of the expansion surfaces of the expansion device and one or more interior surfaces of the tubular member.

25. The apparatus of claim 24, wherein the lubrication system comprises:

a supply of a lubricant; and an injector for injecting the lubricant into the interface.

26. The apparatus of claim 25, wherein the supply of lubricant is provided within the expansion device.

27. The apparatus of claim 25, wherein one or more of the recesses are coupled to the injector.

28. The apparatus of claim 24, wherein the lubrication system comprises:

a lubricating film coupled to one or more of the expansion surfaces.

29. The apparatus of claim 28, wherein at least a portion of the lubricating film is deposited within one or more of the recesses.

30. The apparatus of claim 24, wherein at least some of the recesses are identical to one another.

31. The apparatus of claim 24, wherein at least some of the recesses are equally spaced from one another.

32. The apparatus of claim 24, wherein a depth dimension of the recesses is non-uniform.

33. The apparatus of claim 24, wherein at least some of the recesses intersect.

34. The apparatus of claim 24, wherein a location of at least some of the recesses is randomly distributed.

35. The apparatus of claim 24, wherein a geometry of at least some of the recesses is randomly distributed.

36. The apparatus of claim 24, wherein a surface texture of at least some of the recesses is randomly distributed.

37. The apparatus of claim 24, wherein a geometry of at least some of the recesses is linear.

38. The apparatus of claim 24, wherein a geometry of at least some of the recesses is non-linear.

39. The apparatus of claim 24, wherein the interface comprises a leading edge portion and a trailing edge portion, and wherein the lubrication system provides a higher lubrication concentration in at least one of the leading and trailing edge portions.

40. An apparatus for radially expanding and plastically deforming a tubular member, comprising:

a support member;

an expansion device coupled to an end of the support member comprising one or more expansion surfaces for engaging the tubular member during the radial expansion and plastic deformation of the tubular member; and a lubrication system for lubricating an interface between one or more of the expansion surfaces of the expansion device and one or more interior surfaces of the tubular member, wherein a lubrication concentration provided by the lubrication system is varied as a function of a rate of strain of the tubular member during an operation of the apparatus.

41. The apparatus of claim 40, wherein the function comprises a linear function.

42. The apparatus of claim 40, wherein the function comprises a non-linear function.

43. The apparatus of claim 40, wherein the function comprises a step function.

44. A method for radially expanding and plastically deforming a tubular member, comprising:

radially expanding and plastically deforming the tubular member using an expansion device comprising one or more expansion surfaces, wherein one or more of the expansion surfaces of the expansion device define one or more recesses, and wherein one or more lubricating ball bearings are supported within at least one of the recesses; and lubricating an interface between one or more of the expansion surfaces of the expansion device and one or more interior surfaces of the tubular member.

45. The method of claim 44, further comprising:

injecting a supply of lubricant into the interface.

46. The method of claim 45, wherein the supply of lubricant is provided within the expansion device.

47. The method of claim 44, wherein the method further comprises injecting the supply of lubricant into one or more of the recesses.

48. The method of claim 44, further comprising:

coupling a lubricating film to one or more of the expansion surfaces.

49. The method of claim 48, wherein at least a portion of the lubricating film is coupled to one or more of the recesses.

50. The method of claim 44, wherein at least some of the recesses are identical to one another.

51. The method of claim 44, wherein at least some of the recesses are equally spaced from one another.

52. The method of claim 44, wherein a depth dimension of the recesses are non-uniform.

53. The method of claim 44, wherein at least some of the recesses intersect.

54. The method of claim 44, wherein the location of at least some of the recesses is randomly distributed.

55. The method of claim 44, wherein the geometry of at least some of the recesses is randomly distributed.

56. The method of claim 44, wherein a surface texture of at least some of the recesses is randomly distributed.

57. The method of claim 44, wherein the geometry of at least some of the recesses is linear.

58. The method of claim 44, wherein the geometry of at least some of the recesses is non-linear.

59. The method of claim 44, wherein the interface comprises a leading edge portion and a trailing edge portion; and wherein the method further comprises providing a higher lubrication concentration in at least one of the leading and trailing edge portions.

60. A method for radially expanding and plastically deforming a tubular member, comprising:

radially expanding and plastically deforming the tubular member using an expansion device comprising one or more expansion surfaces;

lubricating an interface between one or more of the expansion surfaces of the expansion device and one or more interior surfaces of the tubular member; and varying a lubrication concentration as a function of a rate of strain of the tubular member during the radial expansion and plastic deformation of the tubular member.

61. The method of claim 60, wherein the function comprises a linear function.

62. The method of claim 60, wherein the function comprises a non-linear function.

63. The method of claim 60, wherein the function comprises a step function.

64. A method for radially expanding and plastically deforming a tubular member, comprising:

radially expanding and plastically deforming the tubular member using an expansion device comprising one or more expansion surfaces;

lubricating an interface between one or more of the expansion surfaces of the expansion device and one or more interior surfaces of the tubular member;

determining one or more characteristics of the interface during the operation of the expansion device; and varying a concentration of a lubricant material within the interface during the operation of the expansion device as a function of one or more of the determined characteristics.

65. A tribological system for lubricating an interface between an expansion device and a tubular member during a radial expansion and plastic deformation of the tubular member, comprising:

an expansion surface coupled to the expansion device defining a surface texture;

a first lubricating film coupled to the expansion surface;

a second lubricating film coupled to an interior surface of the tubular member; and a lubricating material disposed within an annulus defined between the expansion surface of the expansion device and the interior surface of the tubular member.

66. The system of claim 65, wherein a resistance to abrasion of the first lubricating film is greater than a resistance to abrasion of the second lubricating film.

67. The system of claim 65, wherein an $R_a$ for the expansion surface is less than or equal to 60.205 nm.

68. The system of claim 65, wherein an $R_z$ for the expansion surface is less than or equal to 1.99 nm.

69. The system of claim 65, wherein an $R_a$ for the expansion surface is about 60.205 nm.

70. The system of claim 65, wherein an $R_z$ for the expansion surface is about 1.99 nm.

71. The system of claim 65, wherein an $R_a$ for the expansion surface is less than or equal to 277.930 nm.

72. The system of claim 65, wherein an $R_z$ for the expansion surface is less than or equal to 3.13 nm.

73. The system of claim 65, wherein an $R_a$ for the expansion surface is less than or equal to 277.930 nm and greater than or equal to 60.205 nm.

74. The system of claim 65, wherein an $R_z$ for the expansion surface is less than or equal to 3.13 nm and greater than or equal to 1.99 nm.

75. The system of claim 65, wherein the expansion surface comprises a plateau-like surface that defines one or more relatively deep recesses.

76. The system of claim 65, wherein the first lubricating film comprises chromium nitride.

77. The system of claim 65, wherein the second lubricating film comprises PTFE.

78. The system of claim 65, wherein the expansion surface comprises DC53 tool steel.

79. The system of claim 65, wherein a coefficient of friction for the interface is less than or equal to 0.125.

80. The system of claim 65, wherein a coefficient of friction for the interface is less than 0.125.

81. The system of claim 65, wherein a coefficient of friction for the interface is less than or equal to 0.125 and greater than or equal to 0.06.

82. The system of claim 65, wherein a coefficient of friction for the interface is less than or equal to 0.06.

83. The system of claim 65, wherein the expansion surface comprises a polished surface.

84. The system of claim 65, wherein forces required to overcome friction during radial expansion and plastic deformation of the tubular member are less than or equal to 45% of the total forces required to radially expand and plastically deform the tubular member.

85. The system of claim 65, wherein forces required to overcome friction during radial expansion and plastic deformation of the tubular member are less than 45% of the total forces required to radially expand and plastically deform the tubular member.

86. The system of claim 65, wherein forces required to overcome friction during the radial expansion and plastic deformation of the tubular member are less than or equal to 45% and greater than or equal to 8% of the total forces required to radially expand and plastically deform the tubular member.

87. The system of claim 65, wherein forces required to overcome friction during radial expansion and plastic deformation of the tubular member are less than or equal to 8% of the total forces required to radially expand and plastically deform the tubular member.

88. The system of claim 65, wherein a bearing ratio of the expansion surface varies less than about 15%.

89. The system of claim 65, wherein a bearing ratio of the expansion surface of the expansion device is greater than 75% on 60% of an $R_z$ surface roughness.

90. A method of lubricating an interface between an expansion surface of an expansion device and a tubular member during a radial expansion and plastic deformation of the tubular member, comprising:

texturing the expansion surface;

coupling a first lubricating film to the expansion surface;

coupling a second lubricating film to an interior surface of the tubular member; and disposing a lubricating material within an annulus defined between the expansion surface of the expansion device and the interior surface of the tubular member.

91. The method of claim 90, wherein a resistance to abrasion of the first lubricating film is greater than a resistance to abrasion of the second lubricating film.

92. The method of claim 90, wherein an $R_a$ for the expansion surface is less than or equal to 60.205 nm.

93. The method of claim 90, wherein an $R_z$ for the expansion surface is less than or equal to 1.99 nm.

94. The method of claim 90, wherein an $R_a$ for the expansion surface is about 60.205 nm.

95. The method of claim 90, wherein an $R_z$ for the expansion surface is about 1.99 nm.

96. The method of claim 90, wherein an $R_a$ for the expansion surface is less than or equal to 277.930 nm.

97. The method of claim 90, wherein an $R_z$ for the expansion surface is less than or equal to 3.13 nm.

98. The method of claim 90, wherein an for the $R_a$ for the expansion surface is less than or equal to 277.930 nm and greater than or equal to 60.205 nm.

99. The method of claim 90, wherein an $R_z$ for the expansion surface is less than or equal to 3.13 nm and greater than or equal to 1.99 nm.

100. The method of claim 90, wherein the expansion surface comprises a plateau-like surface that defines one or more relatively deep recesses.

101. The method of claim 90, wherein the first lubricating film comprises chromium nitride.

102. The method of claim 90, wherein the second lubricating film comprises PTFE.

103. The method of claim 90, wherein the expansion surface comprises DC53 tool steel.

104. The method of claim 90, wherein a coefficient of friction for the interface is less than or equal to 0.125.

105. The method of claim 90, wherein a coefficient of friction for the interface is less than or equal to 0.125 and greater than or equal to 0.06.

106. The method of claim 90, wherein a coefficient of friction for the interface is less than 0.125 and greater than or equal to 0.06.

107. The method of claim 90, wherein a coefficient of friction for the interface is less or equal to 0.06.

108. The method of claim 90, further comprising polishing the expansion surface.

109. The method of claim 90, wherein forces required to overcome friction during radial expansion and plastic deformation of the tubular member are less than or equal to 45% of the total forces required to radially expand and plastically deform the tubular member.

110. The method of claim 90, wherein forces required to overcome friction during radial expansion and plastic deformation of the tubular member are less than 45% of the total forces required to radially expand and plastically deform the tubular member.

111. The method of claim 90, wherein forces required to overcome friction during radial expansion and plastic deformation of the tubular member are less than or equal to 45% and greater than or equal to 8% of the total forces required to radially expand and plastically deform the tubular member.

112. The method of claim 90, wherein forces required to overcome friction during radial expansion and plastic deformation of the tubular member are less than or equal to 8% of the total forces required to radially expand and plastically deform the tubular member.

113. The method of claim 90, wherein a bearing ratio of the expansion surface varies less than about 15%.

114. The method of claim 90, wherein a bearing ratio of the expansion surface of the expansion device is greater than 75% on 60% of an $R_z$ surface roughness.

115. A tribological system for lubricating an interface between an expansion device and a tubular member during a radial expansion and plastic deformation of the tubular member, comprising:

an expansion surface coupled to the expansion device defining a surface texture;

a first lubricating film coupled to the expansion surface; and a second lubricating film coupled to an interior surface of the tubular member, wherein a resistance to abrasion of the first lubricating film is greater than a resistance to abrasion of the second lubricating film.

116. The tribological system of claim 115, wherein an $R_a$ for the expansion surface is less than or equal to 60.205 nm.

117. The tribological system of claim 115, wherein an $R_z$ for the expansion surface is less than or equal to 1.99 nm.

118. The tribological system of claim 115, wherein an $R_a$ for the expansion surface is about 60.205 nm.

119. The tribological system of claim 115, wherein an $R_z$ for the expansion surface is about 1.99 nm.

120. The tribological system of claim 115, wherein an $R_a$ for the expansion surface is less than or equal to 277.930 nm.

121. The tribological system of claim 115, wherein an $R_z$ for the expansion surface is less than or equal to 3.13 nm.

122. The tribological system of claim 115, wherein an $R_a$ for the expansion surface is less than or equal to 277.930 nm and greater than or equal to 60.205 nm.

123. The tribological system of claim 115, wherein an $R_z$ for the expansion surface is less than or equal to 3.13 nm and greater than or equal to 1.99 nm.

124. The tribological system of claim 115, wherein the expansion surface comprises a plateau-like surface that defines one or more relatively deep recesses.

125. The tribological system of claim 115, wherein the expansion surface comprises DC53 tool steel.

126. The tribological system of claim 115, wherein a coefficient of friction for the interface is less than or equal to 0.125.

127. The tribological system of claim 115, wherein a coefficient of friction for the interface is less than 0.125.

128. The tribological system of claim 115, wherein a coefficient of friction for the interface is less than or equal to 0.125 and greater than or equal to 0.06.

129. The tribological system of claim 115, wherein a coefficient of friction for the interface is less than or equal to 0.06.

130. The tribological system of claim 115, wherein the expansion surface comprises a polished surface.

131. The tribological system of claim 115, wherein forces required to overcome friction during radial expansion and plastic deformation of the tubular member are less than or equal to 45 of the total forces required to radially expand and plastically deform the tubular member.

132. The tribological system of claim 115, wherein forces required to overcome friction during radial expansion and plastic deformation of the tubular member are less than 45% of the total forces required to radially expand and plastically deform the tubular member.

133. The tribological system of claim 115, wherein forces required to overcome friction during radial expansion and plastic deformation of the tubular member are less than or equal to 45% and greater than or equal to 8% of the total forces required to radially expand and plastically deform the tubular member.

134. The tribological system of claim 115, wherein forces required to overcome friction during radial expansion and plastic deformation of the tubular member are less than or equal to 8% of the total forces required to radially expand and plastically deform the tubular member.

135. The tribological system of claim 115, wherein a bearing ratio of the expansion surface varies less than about 15%.

136. The tribological system of claim 115, wherein a bearing ratio of the expansion surface of the expansion device is greater than 75% on 60% of an $R_z$ surface roughness.

137. A tribological system for lubricating an interface between an expansion device and a tubular member during a radial expansion and plastic deformation of the tubular member, comprising:

an expansion surface coupled to the expansion device defining a surface texture; and a lubricating film coupled to the expansion surface, wherein the lubricating film comprises chromium nitride.

138. A tribological system for lubricating an interface between an expansion device and a tubular member during a radial expansion and plastic deformation of the tubular member, comprising:

an expansion surface coupled to the expansion device defining a surface texture; and a lubricating film coupled to an interior surface of the tubular member, wherein the lubricating film comprises PTFE.

* * * * *